US011054192B2

(12) United States Patent
Inoue et al.

(10) Patent No.: US 11,054,192 B2
(45) Date of Patent: Jul. 6, 2021

(54) HEAT EXCHANGER AND AIR CONDITIONER

(71) Applicant: DAIKIN INDUSTRIES, LTD., Osaka (JP)

(72) Inventors: Satoshi Inoue, Osaka (JP); Shun Yoshioka, Osaka (JP); Masanori Jindou, Osaka (JP); Yoshio Oritani, Osaka (JP); Tomohiko Sakamaki, Osaka (JP); Tomoya Yamaguchi, Osaka (JP); Ken Satou, Osaka (JP); Kouju Yamada, Osaka (JP); Hiroaki Matsuda, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/497,604

(22) PCT Filed: Mar. 27, 2018

(86) PCT No.: PCT/JP2018/012470
§ 371 (c)(1),
(2) Date: Sep. 25, 2019

(87) PCT Pub. No.: WO2018/181337
PCT Pub. Date: Oct. 4, 2018

(65) Prior Publication Data

US 2020/0386480 A1 Dec. 10, 2020

(30) Foreign Application Priority Data

Mar. 27, 2017 (JP) ..... JP2017-060764
Sep. 29, 2017 (JP) ..... JP2017-190278

(51) Int. Cl.
*F28F 9/02* (2006.01)
*F28F 1/02* (2006.01)
(Continued)

(52) U.S. Cl.
CPC ..... *F28F 1/022* (2013.01); *F24F 1/18* (2013.01); *F25B 39/00* (2013.01); *F28D 1/0233* (2013.01);
(Continued)

(58) Field of Classification Search
CPC ..... F28F 1/325; F28F 1/18; F28F 1/32; F28F 9/0275; F28F 9/0202; F28F 1/24;
(Continued)

(56) References Cited

U.S. PATENT DOCUMENTS 5,582,239 A 12/1996 Tsunoda et al.
9,791,213 B2 10/2017 Yoshioka et al.
(Continued)

FOREIGN PATENT DOCUMENTS

JP H11-337293 A 12/1999
JP 2015-068622 A 4/2015
(Continued)

OTHER PUBLICATIONS

Office Action dated in the U.S. Appl. No. 16/497,662 dated Mar. 16, 2020 (19 pages).
(Continued)

*Primary Examiner* — Henry T Crenshaw
*Assistant Examiner* — Kamran Tavakoldavani
(74) *Attorney, Agent, or Firm* — Osha Bergman Watanabe & Burton LLP

(57) ABSTRACT

A heat exchanger includes: a header; flat tubes disposed in line along a longitudinal direction of the header and connected to the header: a refrigerant pipe connected to an introduction space in the header; and a nozzle. When the heat exchanger operates as an evaporator of a refrigerant, the refrigerant is fed through the nozzle from the introduction space to a supply space disposed adjacent to the introduction space in the longitudinal direction of the header. The nozzle
(Continued)

is disposed on a side closer to the flat tubes than to the refrigerant pipe. A width of a first zone in the introduction space on the side closer to the flat tubes is smaller than a width of a second zone in the introduction space on a side where the refrigerant pipe is connected.

12 Claims, 16 Drawing Sheets

(51) Int. Cl.

| | |
|---|---|
| ***F28D 1/02*** | (2006.01) |
| ***F28D 1/053*** | (2006.01) |
| ***F24F 1/18*** | (2011.01) |
| ***F25B 39/00*** | (2006.01) |
| ***F28D 1/047*** | (2006.01) |
| ***F28F 1/32*** | (2006.01) |
| *F28D 21/00* | (2006.01) |

(52) U.S. Cl.
CPC ..... *F28D 1/0471* (2013.01); *F28D 1/05366* (2013.01); *F28F 1/32* (2013.01); *F28F 9/02* (2013.01); *F28F 9/0202* (2013.01); *F28D 2021/0068* (2013.01)

(58) Field of Classification Search
CPC .. F28F 9/013; F28F 9/02; F28F 9/0204; F28F 9/0207; F28F 9/0209; F28F 9/0212; F28F 9/0214; F28F 9/0217; F28F 9/0219; F28D 1/05391; F28D 1/0471; F28D 1/05366; F28D 2021/0068; F28D 2001/0266; F28D 1/0316; F28D 1/0366; F28D 1/0375; F28D 1/04; F28D 1/05308; F28D 1/05316; F28D 1/053333; F28D 1/05325; F28D 1/05341; F28D 7/16
USPC ..... 165/175
See application file for complete search history.

(56) References Cited

U.S. PATENT DOCUMENTS

| | | | | |
|---|---|---|---|---|
| 2010/0314090 | A1* | 12/2010 | Moriya | F25B 39/028 165/174 |
| 2013/0126140 | A1 | 5/2013 | Park et al. | |
| 2014/0311702 | A1 | 10/2014 | Takagi | |
| 2015/0021003 | A1 | 1/2015 | Cho et al. | |
| 2015/0345843 | A1 | 12/2015 | Voorhis et al. | |
| 2016/0238322 | A1 | 8/2016 | Inoue et al. | |
| 2016/0327317 | A1 | 11/2016 | Inoue et al. | |

FOREIGN PATENT DOCUMENTS

| | | | | |
|---|---|---|---|---|
| JP | 2015-127618 | A | 7/2015 | |
| JP | 2016-070622 | A | 5/2016 | |
| JP | 2016-125748 | A | 7/2016 | |
| WO | 2012132924 | A1 | 10/2012 | |
| WO | 2015/045564 | A1 | 4/2015 | |
| WO | WO-2015098859 | A1 * | 7/2015 | F28F 1/32 |

OTHER PUBLICATIONS

International Preliminary Report on Patentability issued in corresponding International Patent Application No. PCT/JP2018/012470, dated Oct. 10, 2019 (5 pages).
International Search Report issued in corresponding International Application Na PCT/JP2018/012470 dated Jun. 19, 2018 (3 pages).
Office Action issued in the U.S. Appl. No. 16/497,662, dated Dec. 23, 2020 (20 pages).
Office Action issued in the U.S. Appl. No. 16/497,662, dated Apr. 9, 2021 (12 pages).

* cited by examiner

HEAT EXCHANGER AND AIR CONDITIONER

TECHNICAL FIELD

The present invention relates to a heat exchanger and an air conditioner.

BACKGROUND

A known heat exchanger has a plurality of flat tubes, a fin joined to the plurality of flat tubes, and a header connected to ends of the plurality of flat tubes. This heat exchanger is designed to enable heat exchange between a refrigerant that flows through the flat tubes and air that flows outside the flat tubes.

For example, a heat exchanger described in Patent Literature 1 (JP 2015-127618 A) uses a horizontally spreading partitioning member to partition an inner space of the header into an upper space and a lower space, and also uses an upflow nozzle provided to the partitioning member so as to make enough refrigerant arrive even at the flat tubes that are connected to an upper region of the upper space.

The heat exchanger described in Patent Literature 1, however, has the flat tubes connected not only to the upper space in the header, but also to the lower space.

Now the lower space, which is a space preceding the upflow nozzle and is not susceptible to pressure loss by the upflow nozzle, tends to have pressure higher than in the upper space, so that the refrigerant tends to intensively flow into the flat tubes connected to the lower space.

The flow rate of refrigerant in the flat tubes connected to the upper space may therefore be different from the flow rate of refrigerant in the flat tubes connected to the lower space, possibly causing unequal flow of the refrigerant.

One possible idea is to connect the plurality of flat tubes to the header at the highest possible level above the upflow nozzle, so as to eliminate or reduce unequal flow of refrigerant to the number of the flat tubes. However, for a structure in which the refrigerant is fed from the outside of the header through a refrigerant pipe into the space below the upflow nozzle, there will be another need to eliminate or reduce the number of the flat tubes to be connected to the space to which the refrigerant pipe is connected. Hence, an effort towards connection of the same number of flat tubes will vertically enlarge the heat exchanger, meanwhile an effort towards avoiding the vertical enlargement will raise a need to reduce the number of the flat tubes to be connected, and to degrade the performance.

PATENT LITERATURE

<Patent Literature 1> JP 2015-127618 A

SUMMARY

One or more embodiments of the present invention provide a heat exchanger and an air conditioner, capable of guiding enough refrigerant even towards upper positioned flat tubes, avoiding enlargement and degradation of performance, and suppressing unequal flow of the refrigerant among the plurality of flat tubes.

A heat exchanger according one or more embodiments of the present invention has a header, a plurality of flat tubes, a refrigerant pipe, and a nozzle part (nozzle). The plurality of flat tubes are arranged in line in the longitudinal direction of the header. The plurality of flat tubes are connected to the header. The refrigerant pipe is connected to an introduction space in the header. The nozzle part is used, in the case of functioning as an evaporator of the refrigerant, to feed a refrigerant from the introduction space to a supply space positioned adjacent to the introduction space in the longitudinal direction of the header. The nozzle part is located on a portion closer to the flat tube than to the refrigerant pipe. The introduction space is constructed so as to have a width, measured in the longitudinal direction of the header, narrower in a zone on a side closer to the flat tube where the nozzle part is located, than in a zone on a side closer to the refrigerant pipe. The flat tube is not limited, and may typically be any of those having a plurality of flow channels formed therein so as to be arranged in line in the longitudinal direction of cross section of the flow channels.

Such heat exchanger, with the nozzle part designed to feed the refrigerant from the introduction space to the supply space, makes it possible to feed enough refrigerant even to the flat tubes connected to the supply space, which is a space next to the introduction space in the header.

Even in a case where the refrigerant is fed from the outside of the header through the refrigerant pipe, the introduction space is constructed so as to have the width, measured in the longitudinal direction of the header, narrower in the zone closer to the nozzle part, than in a zone where the refrigerant pipe is connected. This successfully reduces the number of flat tubes to be connected to the introduction space in which the refrigerant flows before passing through the nozzle part. Hence, it becomes possible to locate as many flat tubes connected to the header as possible to the supply space next to the nozzle part, and to eliminate or reduce the flat tubes to be connected to the zone where the pressure tends to increase before passage through the nozzle part. This consequently eliminates or reduces the flat tubes through which the refrigerant intensively flows, and suppresses unequal flow of the refrigerant among the plurality of flat tubes.

Also since the introduction space may be constructed to have the width, in the longitudinal direction of the header, narrower in the zone closer to the nozzle part, a sufficient number of flat tubes, less susceptible to unequal flow, may be connected to the zone in the supply space next to the nozzle part. This successfully suppresses the heat exchanger from being enlarged in the longitudinal direction of the header, while suppressing degradation of the performance which is anticipated in the effort of eliminating or reducing the flat tubes to be connected to the introduction space intended for suppressing the unequal flow.

In this way, it becomes possible to suppress enlargement and performance degradation and to suppress unequal flow of refrigerant among the plurality of flat tubes, while feeding enough refrigerant also to the flat tubes connected to the supply space of the header.

In a heat exchanger according to one or more embodiments of the present invention, the plurality of flat tubes are connected only to the supply space in the header.

In this heat exchanger, the plurality of flat tubes are connected only to the supply space in the header, but not connected to the introduction space. This means that there is no flat tube connected to the space, preceding the nozzle part, where the pressure is kept relatively high, but instead all flat tubes are connected to the space succeeding the nozzle part. This successfully eliminates the flat tubes through which the refrigerant intensively flows, and to sufficiently suppress the unequal flow among the plurality of flat tubes.

In a heat exchanger according to one or more embodiments of the present invention, the width, measured in the longitudinal direction of the header, of a zone in the introduction space closer to the flat tube and where the nozzle part is located, is narrower than a width, measured in the longitudinal direction of the header of the refrigerant pipe, where makes contact with the introduction space.

Such structure is not limited, and may be exemplified by a case where the plurality of flat tubes are arranged in line at predetermined intervals in the longitudinal direction of the header, and each interval is narrower than the outer diameter of the refrigerant pipe.

Such heat exchanger is fed by the refrigerant from the outside of the header through the refrigerant pipe, and even if constructed so that the width of the zone in the introduction space where the nozzle part is provided is narrower than the width of the refrigerant pipe in the longitudinal direction of the header, the introduction space is constructed so that the zone having the nozzle part has the width, measured in the longitudinal direction of the header, narrower than in the zone connected to the refrigerant pipe. Therefore, it becomes possible to connect the refrigerant pipe to the introduction space, while suppressing unequal flow of refrigerant among the flat tubes, and to suppress enlargement and performance degradation of the heat exchanger.

In a heat exchanger according to one or more embodiments of the present invention, the refrigerant pipe is a cylindrical pipe.

Such heat exchanger, with a cylindrical refrigerant pipe, can increase the compressive strength with a simple shape. Using such cylindrical refrigerant pipe may, however, make it difficult to narrow the width in the longitudinal direction of the header as compared with a case where the same flow channel area will be achieved with a flat-shape refrigerant pipe, and the width in the longitudinal direction of the header will tend to be wider. Despite such cylindrical refrigerant pipe that tends to expand the width in the longitudinal direction of the header, since the width, measured in the longitudinal direction of the header, of the zone in the introduction space where the nozzle part is provided is made narrower than the outer diameter of the cylindrical refrigerant pipe in this heat exchanger, so that it becomes possible to suppress unequal flow of the refrigerant among the flat tubes, and to suppress enlargement and performance degradation of the heat exchanger.

A heat exchanger according to one or more embodiments of the present invention further includes a first partition part (a first partition), and a first guide part (a first guide). The first partition part has formed therein the nozzle part. The first partition part partitions the inside of the header, on the side closer to the flat tubes, into the introduction space and the supply space. The first guide part is provided on a side opposite to the flat tubes of the first partition part, and extends so as to become closer to the supply space continuously or stepwisely as extending toward the side opposite to the flat tubes.

The nozzle part may alternatively be provided by forming a part that passes through the first partition part so as to extend in the longitudinal direction of the header.

The first partition part may alternatively be made into a plate-shape that extends over a plane orthogonal to the longitudinal direction of the header.

In this heat exchanger, even if a position, of a part of the first guide part, on the side opposite to the flat tubes side in the longitudinal direction of the header is positioned in the supply space side of the end, on the side closer to the introduction space in the longitudinal direction of the header, of the nozzle part, the refrigerant introduced through the refrigerant pipe into the introduction space can be guided to the side opposite to the supply space side in the longitudinal direction of the header by using an introduction space side surface of the first guide part facing the introduction space, making it possible to guide the refrigerant to a zone on the side of the introduction space relative to the nozzle formed in the first partition part. Hence, even if a position, of a part of the first guide part, on the side opposite to the flat tubes side in the longitudinal direction of the header is positioned in the supply space side of the end, on the side closer to the introduction space, of the nozzle part, it now becomes possible to guide the refrigerant to the zone on the side of introduction space side of the nozzle. In addition, by positioning a position of the end, on the side closer to the supply space in the longitudinal direction of the header, of the zone on the side closer to the flat tubes in the introduction space toward the side opposite to the supply space, it now becomes possible to suppress or avoid connection of the flat tubes to the introduction space.

Since the first guide part extends in the longitudinal direction of the header so as to become closer to the supply space continuously and stepwisely (i.e., in a stepwise manner) as extending toward the side opposite to the flat tubes, it becomes possible to position the end, on the side closer to the supply space, of the refrigerant pipe connected to the introduction space in the longitudinal direction of the header, closer to the supply space.

In this heat exchanger, the end of the introduction space, on the side closer to the supply space, may be composed of the first partition part and the first guide part, and the end of the introduction space, on the side opposite to the supply space, may be composed of a flat plate that extends orthogonally to the longitudinal direction of the header. In case of such employment of the flat plate, and if the refrigerant pipe has a large width, measured in the longitudinal direction of the header, at the end on the side where the refrigerant pipe is connected to the introduction space, it is anticipated that, among the ends of the refrigerant pipe on the side where the refrigerant pipe is connected to the introduction space, the end on the side closer to the supply space in the longitudinal direction of the header, will tend to be positioned closer to the supply space. For example, there may be a case where the end is positioned closer to the supply space in the longitudinal direction of the header, as compared with the end, on the side closer to the introduction space in the longitudinal direction of the header, of the flat tube which is closest to the nozzle part, among the plurality of flat tubes that reside in the supply space next to the nozzle part. Even in such case, the first guide part extends so as to become closer to the supply space in the longitudinal direction of the header as extending toward the side opposite to the flat tubes, so that among the ends of the refrigerant pipe on the side the refrigerant pipe is connected to the introduction space, the end on the side closer to the supply space in the longitudinal direction of the header may be positioned farther from the supply space of the first guide part.

In a heat exchanger according to one or more embodiments of the present invention, the first partition part and the first guide part serve as an integrated member to partition the inside of the header into the introduction space and the supply space.

Such heat exchanger, making the first partition part and the first guide part serve as an integrated member that partitions the inside of the header into the introduction space and supply space, can reduce the number of components.

A heat exchanger according to one or more embodiments of the present invention further includes a flat tube-side wall part and a second guide part (second guide). The flat tube-side wall part forms a wall of the introduction space, on the side closer to the flat tubes and on the side opposite to the supply space side in the longitudinal direction of the header. The second guide part is provided on a side opposite to the flat tubes of the flat tube-side wall part, and extends so as to become farther from the supply space continuously or stepwisely as extending toward the side opposite to the flat tubes.

The flat tube-side wall part may alternatively be formed into a plate shape that extends over a plane orthogonal to the longitudinal direction of the header.

In such heat exchanger, even if a portion where the refrigerant pipe is connected to the introduction space contains a portion that is positioned on the introduction space side relative to the flat tube-side wall part in the longitudinal direction of the header, the refrigerant introduced through the refrigerant pipe into the introduction space can be guided deeper to the supply space side opposite to the introduction space side, of the flat tube-side wall part, with the aid by a supply space side surface of the second guide part. Hence, even if a portion where the refrigerant pipe is connected to the introduction space contains a portion that is positioned on the introduction space side relative to the flat tube-side wall part in the longitudinal direction of the header, it becomes possible to feed the refrigerant to a point on the supply space side of the flat tube-side wall part. In addition, with the position of the end, on the side opposite to the supply space in the longitudinal direction of the header, of the zone in the introduction space on the side closer to the flat tubes, set deeply to the supply space side, it now becomes possible to suppress connection of the flat tubes to the introduction space.

Also since the second guide part extends so as to become farther from the supply space in the longitudinal direction of the header as extending toward the side opposite to the flat tubes, the end, on the side opposite to the supply space in the longitudinal direction of the header, of the refrigerant pipe connected to the introduction space may be positioned closer to the supply space, than the second guide part is positioned.

In such heat exchanger, the end, on the side opposite to the supply space in the longitudinal direction of the header, of the introduction space may be composed of the flat tube-side wall part and the second guide part, meanwhile the end, on the side closer to the supply space in the longitudinal direction of the header, of the introduction space may be composed of a flat plat that extends over a plane orthogonal to the longitudinal direction of the header, with the nozzle parts formed therein. In case of such employment of the flat plate, and if the refrigerant pipe has a large width, in the longitudinal direction of the header, at the end on the side where the refrigerant pipe is connected to the introduction space, it is anticipated that, among the ends of the refrigerant pipe on the side where the refrigerant pipe is connected to the introduction space, the end on the side opposite to the supply space in the longitudinal direction of the header will tend to be positioned farther from the supply space. Even in such case, the second guide part extends so as to become farther from the supply space as extending toward the side opposite to the flat tubes, so that among the ends of the refrigerant pipe connected to the introduction space, the end on the side opposite to the supply space in the longitudinal direction of the header may be positioned closer to the supply space, than the second guide part is positioned.

In a heat exchanger according one or more embodiments of the present invention, the flat tube-side wall part and the second guide part serve as an integrated member to compose a bottom of the introduction space.

Such heat exchanger, making the flat tube-side wall part and the second guide part serve as an integrated member that composes a part of the introduction space on the side opposite to the supply space, can reduce the number of components.

A heat exchanger according to one or more embodiments of the present invention further includes the first partition part, the first guide part, the flat tube-side wall part, and a second lower guide part. The first partition part has formed therein the nozzle part. The first partition part partitions the inside of the header, on the side closer to the flat tubes, into the introduction space and the supply space. The first guide part is provided on a side opposite to the flat tubes of the first partition part, and extends so as to become closer to the supply space continuously or stepwisely as extending toward the side opposite to the flat tubes. The flat tube-side wall part forms a wall of the introduction space, on the side closer to the flat tubes and on the side opposite to the supply space side in the longitudinal direction of the header. The second guide part is provided on a side opposite to the flat tubes of the flat tube-side wall part, and extends so as to become farther from the supply space continuously or stepwisely as extending toward the side opposite to the flat tubes. The refrigerant pipe is connected to a zone surrounded by the first guide part and the second guide part.

The nozzle part may alternatively be provided by forming a part that passes through the first partition part so as to extend in the longitudinal direction of the header.

The first partition part may alternatively be made into a plate-shape that extends over a plane orthogonal to the longitudinal direction of the header.

The flat tube-side wall part may alternatively be formed into a plate shape that extends over a plane orthogonal to the longitudinal direction of the header.

In this heat exchanger, even if a position, of a part of the first guide part, on the side opposite to the flat tubes side in the longitudinal direction of the header is positioned in the supply space side of the end, on the side closer to the introduction space in the longitudinal direction of the header, of the nozzle part, the refrigerant introduced through the refrigerant pipe into the introduction space can be guided to the side opposite to the supply space side in the longitudinal direction of the header by using an introduction space side surface of the first guide part facing the introduction space, making it possible to guide the refrigerant to a zone on the side of the introduction space relative to the nozzle formed in the first partition part. Hence, even if a position, of a part of the first guide part, on the side opposite to the flat tubes side in the longitudinal direction of the header is positioned in the supply space side of the end, on the side closer to the introduction space, of the nozzle part, it now becomes possible to guide the refrigerant to the zone on the side of introduction space side of the nozzle. In addition, by positioning a position of the end, on the side closer to the supply space in the longitudinal direction of the header, of the zone on the side closer to the flat tubes in the introduction space toward the side opposite to the supply space, it now becomes possible to suppress or avoid connection of the flat tubes to the introduction space.

Further, in such heat exchanger, even if a portion where the refrigerant pipe is connected to the introduction space contains a portion that is positioned on the introduction space side relative to the flat tube-side wall part in the longitudinal direction of the header, the refrigerant introduced through the refrigerant pipe into the introduction space can be guided deeper to the supply space side opposite to the introduction space side, of the flat tube-side wall part, with the aid by a supply space side surface of the second guide part. Hence, even if a portion where the refrigerant pipe is connected to the introduction space contains a portion that is positioned on the introduction space side opposite side relative to the flat tube-side wall part in the longitudinal direction of the header, it becomes possible to feed the refrigerant to a point on the supply space side of the flat tube-side wall part. In addition, with the position of the end, on the side opposite to the supply space in the longitudinal direction of the header, of the zone in the introduction space on the side closer to the flat tubes, set deeply to the supply space side, it now becomes possible to suppress connection of the flat tubes to the introduction space.

In such heat exchanger, the first guide part extends so as to be positioned closer to the supply space in the longitudinal direction of the header as extending toward the side opposite to the flat tubes, so that the end, on the side closer to the supply space in the longitudinal direction of the header, of the refrigerant pipe connected to the introduction space may become closer to the supply space, and so that the position of the end, on the side closer to the supply space in the longitudinal direction of the header, of the zone on the side closer to the flat tubes in the introduction space, may be set on the side opposite to the supply space. In addition, the second guide part extends so as to become farther from the supply space as extending toward the side opposite to the flat tubes, so that the end, on the side opposite to the supply space in the longitudinal direction of the header, of the refrigerant pipe connected to the introduction space may be positioned farther from the supply space, and so that the position of the end, on the side opposite to the supply space in the longitudinal direction of the header, of the zone on the side closer to the flat tubes in the introduction space, may be set closer to the supply space. Hence, even if the outer diameter of the refrigerant pipe connectable to the introduction space is large, the flat tubes may be suppressed from being connected to the introduction space.

Also since the refrigerant pipe is connected to a part surrounded by the first guide part and the second guide part, much of the refrigerant introduced through the refrigerant pipe into the introduction space may be fed into the zone surrounded by the first partition part and the flat tube-side wall part, while being suppressed from colliding on the first guide part and the second guide part. This successfully reduces pressure loss possibly caused by the collision of the refrigerant to the first guide part and the second guide part.

A heat exchanger according to one or more embodiments of the present invention further includes a supply space partitioning member (a supply space partition). The supply space partitioning member partitions the supply space in the header, into a first space to which the plurality of flat tubes are connected, and a second space on the side opposite to the side the plurality of flat tubes are connected. A region in the first space, which resides on a side opposite to the introduction space in the longitudinal direction of the header, and a region in the second space, which resides on a side opposite to the introduction space in the longitudinal direction of the header, communicate through a first communication path. A region in the first space, which resides on a side closer to the introduction space in the longitudinal direction of the header, and a region in the second space, which resides on a side closer to the introduction space in the longitudinal direction of the header, communicate through a second communication path. Such heat exchanger is constructed so that the refrigerant after passing through the nozzle part circulates through the first space, the first communication path, the second space, and the second communication path.

In such heat exchanger, the supply space, among the spaces in the header, is partitioned by the supply space partitioning member into the first space on the side closer to the flat tubes, and the second space on the side opposite to the flat tubes. As compared with the case without the supply space partitioning member, the case with the supply space partitioning member can narrow a space on the side where the refrigerant can flow in the longitudinal direction of the header towards the supply space, and can more easily allow the refrigerant to reach the side opposite to the introduction space, even if the volume of circulation of the refrigerant in the heat exchanger is relatively small. Meanwhile, if the volume of circulation of the refrigerant in the heat exchanger is large enough to allow the refrigerant to pass at higher velocity by inlets and outlets of the flat tubes, the refrigerant may be circulated through the first space, the first communication path, the second space, and the second communication path, and may be guided again to the flat tubes.

In a heat exchanger according to one or more embodiments of the present invention, the longitudinal direction of the header is a vertical direction.

Such heat exchanger, although with a plurality of vertically arranged flat tubes connected to the header that rises up vertically, can sufficiently feed the refrigerant also to the flat tubes that are connected to the upper part of the supply space.

An air conditioner according to one or more embodiments of the present invention has a refrigerant circuit through which the refrigerant circulates. The refrigerant circuit has the heat exchanger according to one or more embodiments described above.

The air conditioner is provided with the heat exchanger that is capable of guiding enough refrigerant even towards the flat tubes connected to an upper part of the header, and is designed to avoid enlargement, and to suppress unequal flow of the refrigerant among the plurality of flat tubes, and thus the air conditioner can improve the performance.

DETAILED DESCRIPTION

Embodiments of an air conditioner having an outdoor heat exchanger as a heat exchanger, and relevant Modified Examples will be explained below, referring to the attached drawings. Note that a specific structure of the outdoor heat exchanger, as a heat exchanger, is not limited to the embodiments and the Modified Examples described below, and may be modified without departing from their spirits.

(1) Structure of Air Conditioner

Figure 1:
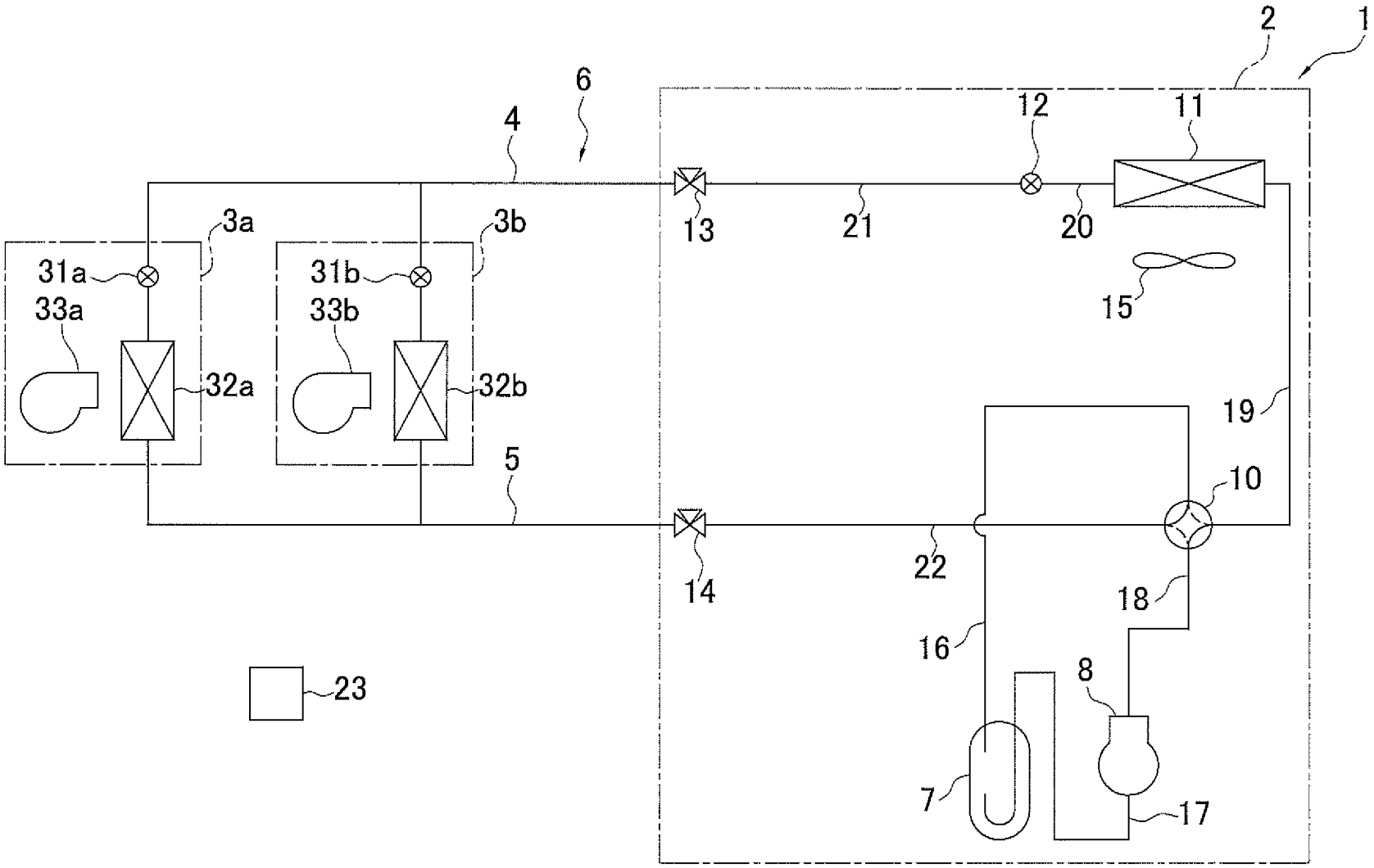
FIG. 1 is a schematic structure diagram of an air conditioner having a heat exchanger according to one or more embodiments.

FIG. 1 is a schematic structure diagram of an air conditioner 1 according to one or more embodiments, having an outdoor heat exchanger 11 as a heat exchanger.

The air conditioner 1 is an apparatus capable of indoor cooling and heating of buildings and so forth, by running a vapor compression refrigeration cycle. The air conditioner 1 mainly has an outdoor unit 2; indoor units 3*a*, 3*b*; a liquid-refrigerant connection pipe 4 and a gas-refrigerant connection pipe 5 that connect the outdoor unit 2 and the indoor units 3*a*, 3*b*; and a control unit 23 that controls component equipment of the outdoor unit 2 and the indoor units 3*a*, 3*b*. A vapor compression-type refrigerant circuit 6 of the air conditioner 1 is constructed by connecting the outdoor unit 2 and the indoor units 3*a*, 3*b* through the refrigerant connection pipes 4, 5.

The outdoor unit 2 is installed outdoors (on building roofs or at around wall surfaces of building), and composes a part of the refrigerant circuit 6. The outdoor unit 2 mainly has an accumulator 7, a compressor 8, a four-way switching valve 10, an outdoor heat exchanger 11, an outdoor expansion valve 12 as an expansion mechanism, a liquid-side shutoff valve 13, a gas-side shutoff valve 14, and an outdoor fan 15. The individual equipment and valves are connected through refrigerant pipes 16 to 22.

The indoor units 3*a*, 3*b* are installed indoors (living room, ceiling space, etc.), and composes a part of the refrigerant circuit 6. The indoor unit 3*a* mainly has an indoor expansion valve 31*a*, an indoor heat exchanger 32*a*, and an indoor fan 33*a*. The indoor unit 3*b* mainly has an indoor expansion valve 31*b* as an expansion mechanism, an indoor heat exchanger 32*b*, and an indoor fan 33*b*.

The refrigerant connection pipes 4, 5 are installed on site, when the air conditioner 1 is installed at an installation site of building. One end of the liquid-refrigerant connection pipe 4 is connected to the liquid-side shutoff valve 13 of the outdoor unit 2, and the other end of the liquid-refrigerant connection pipe 4 is connected to liquid side ends of the indoor expansion valves 31*a*, 31*b* of the indoor units 3*a*, 3*b*. One end of the gas-refrigerant connection pipe 5 is connected to the gas-side shutoff valve 14 of the outdoor unit 2, and the other end of the gas-refrigerant connection pipe 5 is connected to gas-side ends of the indoor heat exchangers 32*a*, 32*b* of the indoor units 3*a*, 3*b*.

The control unit 23 is constructed by control boards (not illustrated) provided to the outdoor unit 2 and the indoor units 3*a*, 3*b*, connected by communication. Note that the outdoor unit 2 and the indoor units 3*a*, 3*b* in FIG. 1 are illustrated as being apart from each other for convenience. The control unit 23 is designed to control the component equipment 8, 10, 12, 15, 31*a*, 31*b*, 33*a*, 33*b* of the air conditioner 1 (the outdoor unit 2 and the indoor units 3*a*, 3*b*, herein), that is, to be responsible for overall control of the air conditioner 1.

(2) Operations of Air Conditioner

Next, operations of the air conditioner 1 will be explained referring to FIG. 1. The air conditioner 1 is responsible for cooling operation allowing a refrigerant to flow through the compressor 8, the outdoor heat exchanger 11, the outdoor expansion valve 12 as well as the indoor expansion valves 31*a*, 31*b*, and the indoor heat exchangers 32*a*, 32*b* in that order; and heating operation allowing the refrigerant to flow through the compressor 8, the indoor heat exchangers 32*a*, 32*b*, the indoor expansion valves 31*a*, 31*b* as well as the outdoor expansion valve 12, and the outdoor heat exchanger 11 in that order. The cooling operation and the heating operation are controlled by the control unit 23.

In the cooling operation, the four-way switching valve 10 is switched into outdoor radiation mode (indicated by solid lines in FIG. 1). In the refrigerant circuit 6, low pressure gas refrigerant in the refrigeration cycle is sucked by the compressor 8, compressed to a high pressure level for the refrigeration cycle, and is then discharged. The high pressure gas refrigerant discharged from the compressor 8 is fed through the four-way switching valve 10 to the outdoor heat exchanger 11. The high pressure gas refrigerant fed to the outdoor heat exchanger 11 is subjected, in such outdoor heat exchanger 11 that functions as a radiator for the refrigerant, to heat exchange with outdoor air which is fed as a cooling source by the outdoor fan 15 so as to dissipate heat, and is converted into high pressure liquid refrigerant. The high pressure liquid refrigerant then dissipates heat in the outdoor heat exchanger 11, and is fed through the outdoor expansion valve 12, the liquid-side shutoff valve 13, and the liquid-refrigerant connection pipe 4, to the indoor expansion valves 31*a*, 31*b*. The refrigerant fed to the indoor expansion valves 31*a*, 31*b* is decompressed by the indoor expansion valves 31*a*, 31*b* down to a low pressure level for the refrigeration cycle, to be converted into low pressure refrigerant in gas-liquid two-phase state. The low pressure refrigerant in gas-liquid two-phase state decompressed in the indoor expansion valves 31*a*, 31*b* is fed to the indoor heat exchangers 32*a*, 32*b*. The low pressure refrigerant in gas-liquid two-phase state, fed to the indoor heat exchangers 32*a*, 32*b*, is then subjected in the indoor heat exchangers 32*a*, 32*b* to heat exchange with indoor air that is fed as a heating source by the indoor fans 33*a*, 33*b*, and evaporates. The indoor air is thus cooled, and then fed indoors for indoor cooling. The low pressure gas refrigerant evaporated in the indoor heat exchangers 32*a*, 32*b* is again sucked by the compressor 8, after being routed through the gas-refrigerant connection pipe 5, the gas-side shutoff valve 14, the four-way switching valve 10, and the accumulator 7.

In the heating operation, the four-way switching valve 10 is switched into outdoor evaporation mode (indicated by broken lines in FIG. 1). In the refrigerant circuit 6, low pressure gas refrigerant in the refrigeration cycle is sucked by the compressor 8, compressed to a high pressure level for the refrigeration cycle, and is then discharged. The high pressure gas refrigerant discharged from the compressor 8 is fed through the four-way switching valve 10, the gas-side shutoff valve 14 and the gas-refrigerant connection pipe 5 to the indoor heat exchangers 32*a*, 32*b*. The high pressure gas refrigerant fed to the indoor heat exchangers 32*a*, 32*b* is subjected, in such indoor heat exchangers 32*a*, 32*b*, to heat exchange with indoor air which is fed as a cooling source by the indoor fans 33*a*, 33*b* so as to dissipate heat, and is converted into high pressure liquid refrigerant. The indoor air is thus heated, and then fed indoors for indoor heating. The high pressure liquid refrigerant then dissipates heat in the indoor heat exchangers 32*a*, 32*b*, and is fed through the indoor expansion valves 31*a*, 31*b*, the liquid-refrigerant connection pipe 4, and the liquid-side shutoff valve 13, to the outdoor expansion valve 12. The refrigerant fed to the outdoor expansion valve 12 is decompressed by the outdoor expansion valve 12 down to a low pressure level for the refrigeration cycle, to be converted into low pressure refrigerant in gas-liquid two-phase state. The low pressure refrigerant in gas-liquid two-phase state decompressed in the outdoor expansion valve 12 is fed to the outdoor heat exchanger 11. The low pressure refrigerant in gas-liquid two-phase state, fed to the outdoor heat exchanger 11, is then subjected in the outdoor heat exchanger 11 functioning as an evaporator of refrigerant to heat exchange with outdoor air that is fed as a heating source by the outdoor fan 15, then evaporated to be converted into low pressure gas refrigerant. The low pressure refrigerant evaporated in the outdoor heat exchanger 11 is again sucked by the compressor 8, after being routed through the four-way switching valve 10 and the accumulator 7.

(3) Structure of Outdoor Unit

Figure 2:
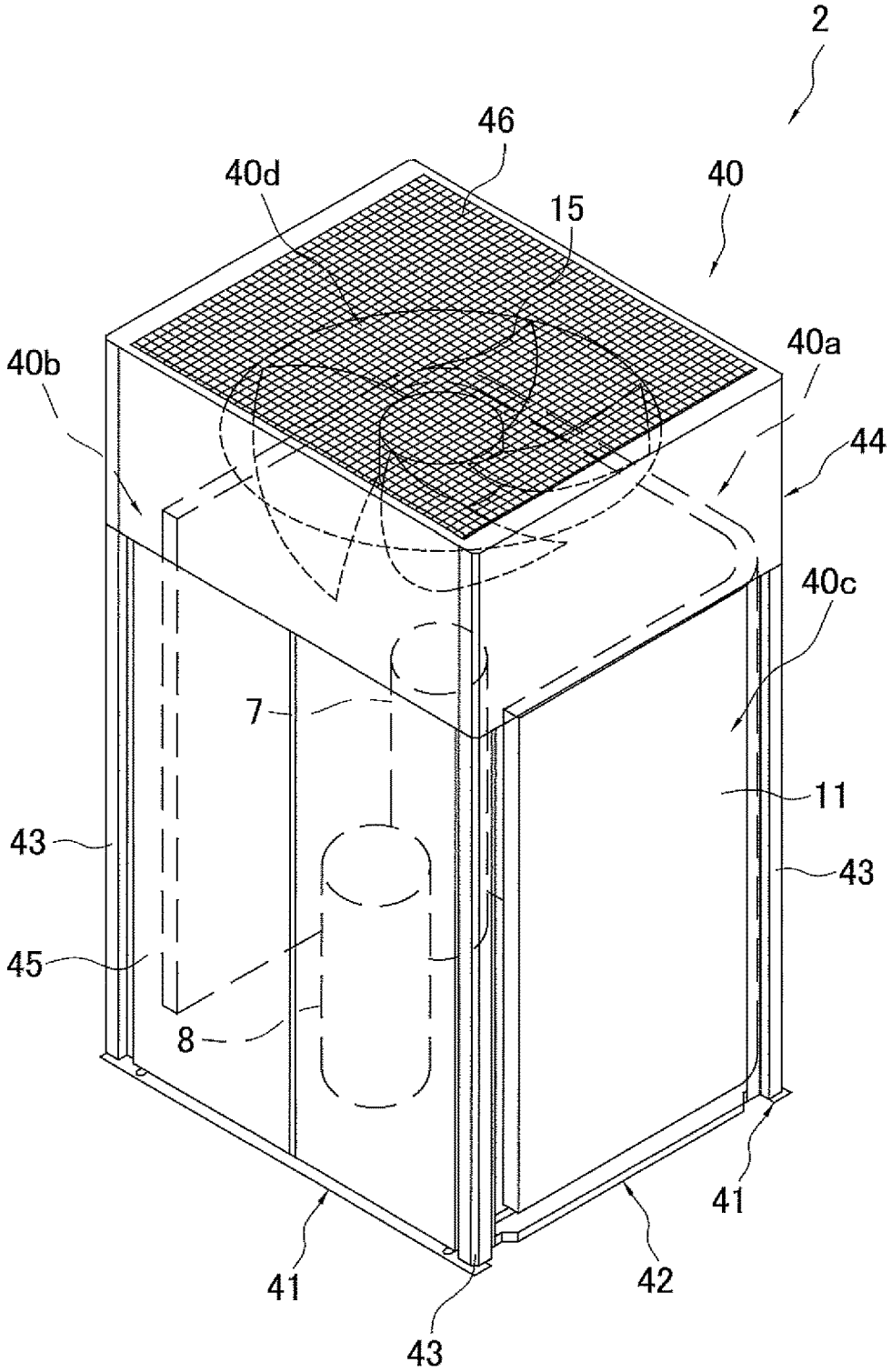
FIG. 2 is an external perspective view of an outdoor unit.
Figure 3:
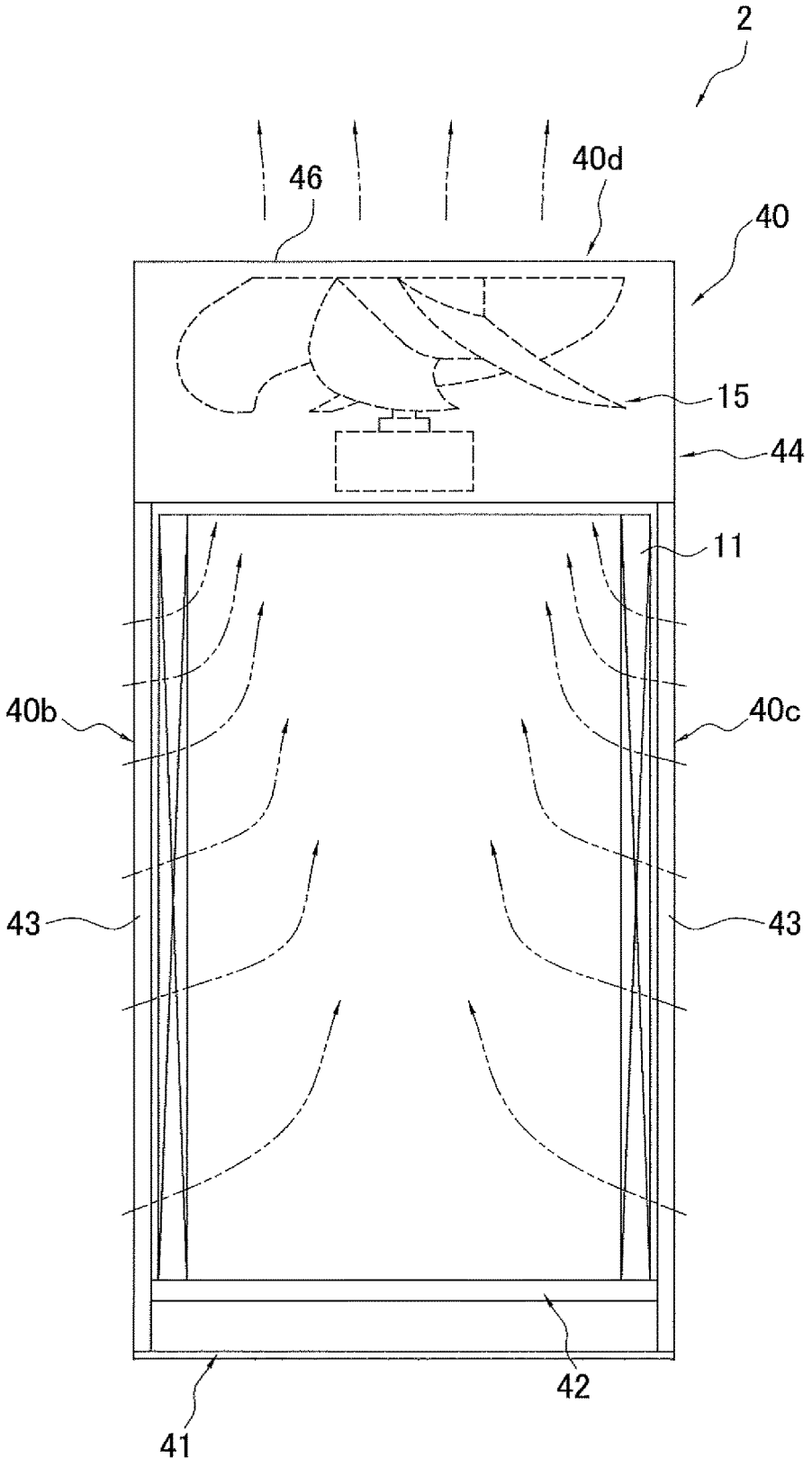
FIG. 3 is a front elevation of the outdoor unit (illustrated excluding refrigerant circuit components other than an outdoor heat exchanger).
Figure 4:
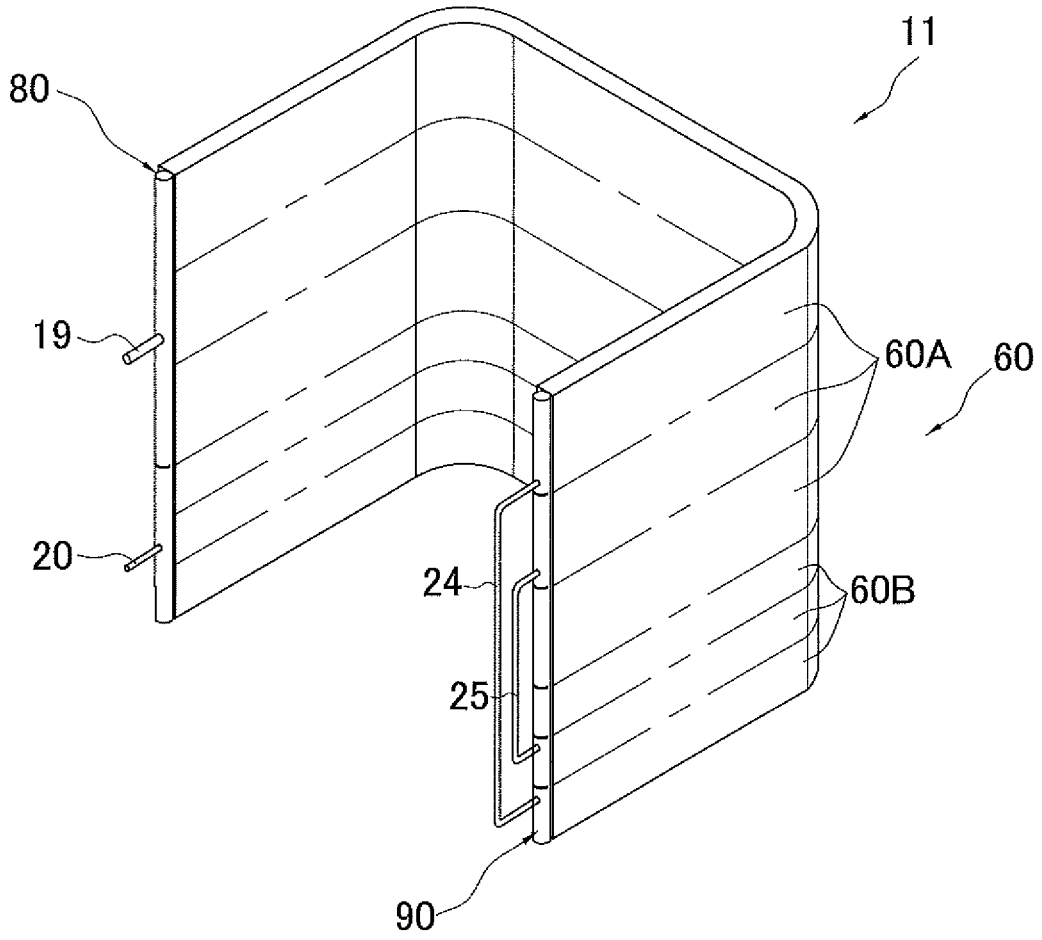
FIG. 4 is a schematic perspective view of the outdoor heat exchanger.
Figure 5:
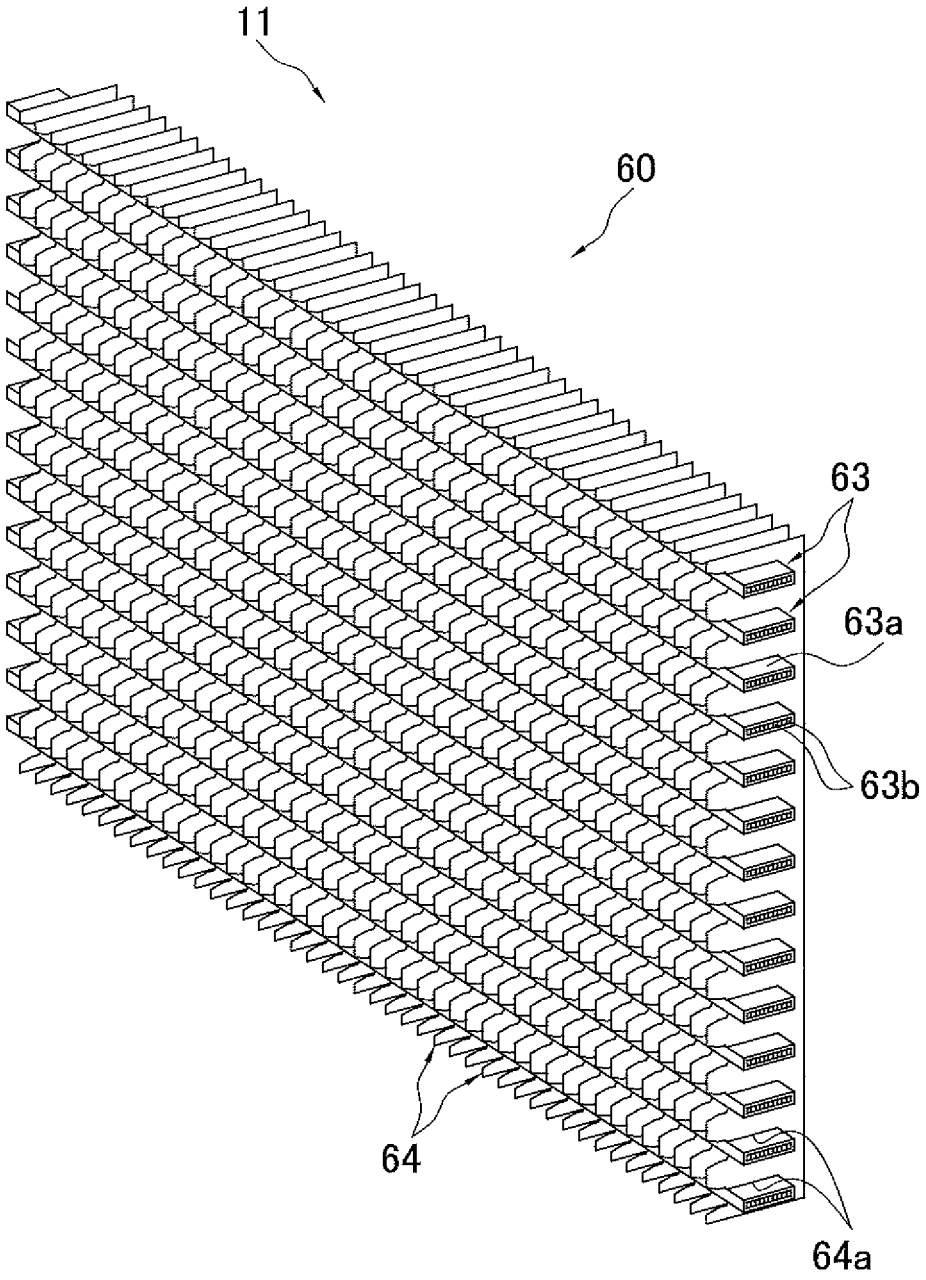
FIG. 5 is a partial enlarged view of a heat exchanging unit illustrated in FIG. 4.
Figure 6:
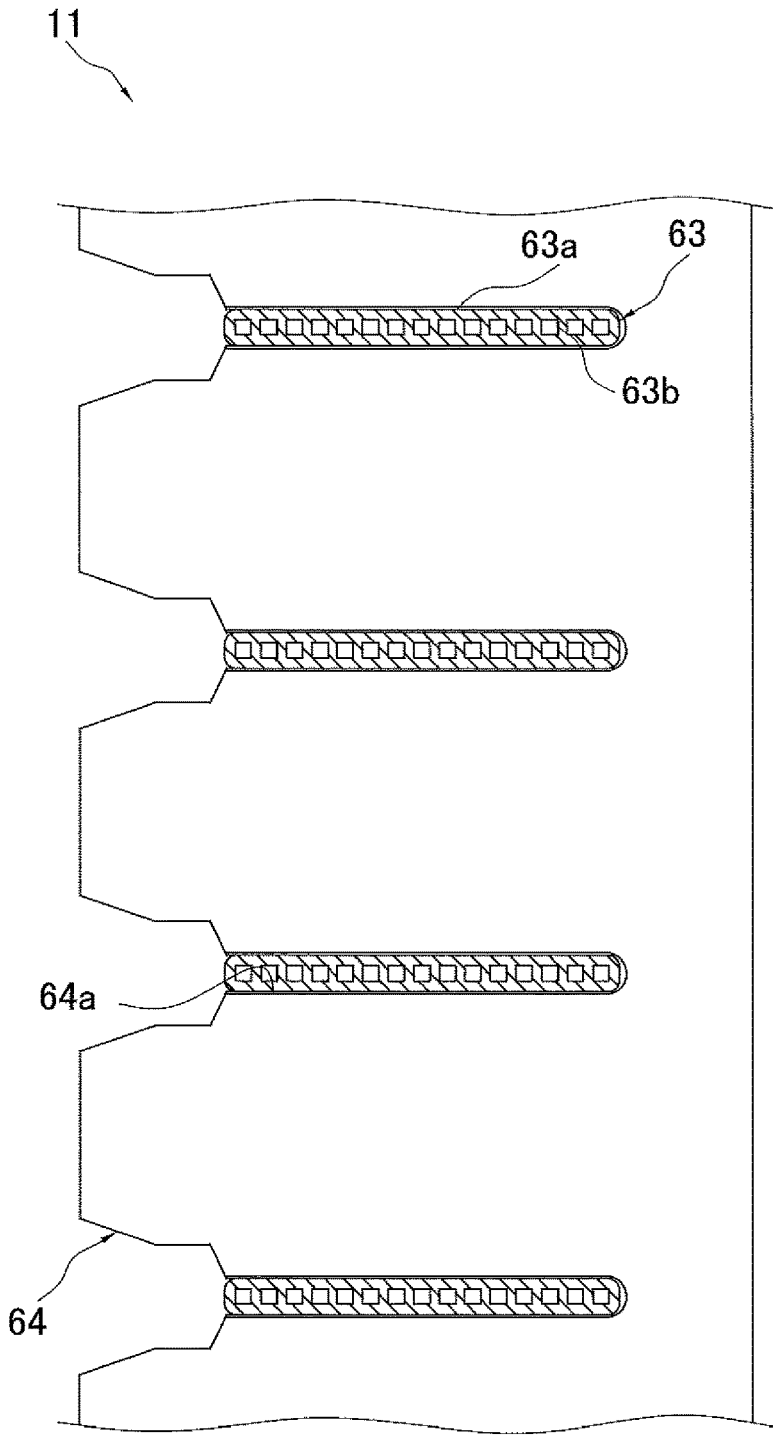
FIG. 6 is a schematic drawing illustrating a state of attachment of heat transfer fins to flat multi-hole tubes.
Figure 7:
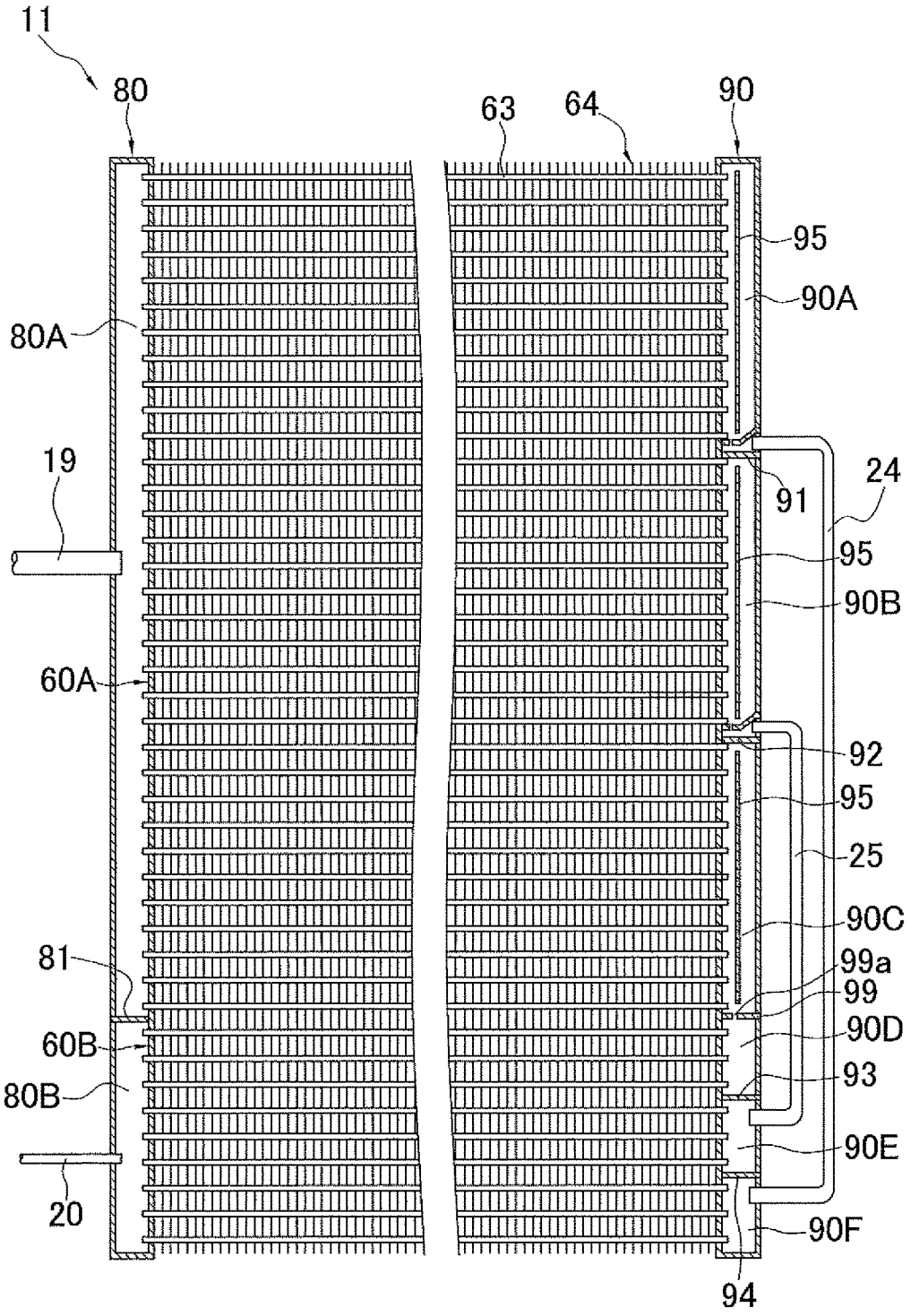
FIG. 7 is a structure diagram explaining flow of refrigerant in the outdoor heat exchanger.

FIG. 2 is an external perspective view of the outdoor unit 2. FIG. 3 is a front elevation of the outdoor unit 2 (illustrated excluding refrigerant circuit components other than the outdoor heat exchanger 11). FIG. 4 is a schematic perspective view of the outdoor heat exchanger 11. FIG. 5 is a partial enlarged view of a heat exchanging unit 60 illustrated in FIG. 4. FIG. 6 is a schematic drawing illustrating a state of attachment of fins 64 to flat multi-hole tubes 63. FIG. 7 is a structure diagram explaining flow of refrigerant in the outdoor heat exchanger 11.

(3-1) Overall Structure

The outdoor unit 2 is a top-blown-type heat exchanging unit that sucks the air through side faces of a casing 40 and blows out the air from the top face of the casing 40. The outdoor unit 2 mainly has the casing 40 in the form of substantially rectangular box; the outdoor fan 15 as an air blower; and refrigerant circuit components that compose a part of the refrigerant circuit 6 including equipment 7, 8, 11 such as the compressor and the outdoor heat exchanger, the valves 10, 12 to 14 such as the four-way switching valve and the outdoor expansion valve, and the refrigerant pipes 16 to 22. Note that terms "upper", "lower", "left", "right", "front", "rear", "front face", and "rear face" in the description below will follow the directionality when the outdoor unit 2 illustrated in FIG. 2 is viewed from the front (diagonally front left in the drawing), unless specifically noted otherwise.

The casing 40 mainly has a bottom frame 42 that is laid across a pair of installation legs 41 that are laterally extended, supports 43 that extend vertically from corners of the bottom frame 42, a fan module 44 mounted on the top ends of the supports 43, and a front panel 45, and has air intake ports 40*a*, 40*b*, 40*c* formed in side faces (rear face, and left and right side faces, herein), and an air blow-out port 40*d* formed in the top face.

The bottom frame 42 forms a bottom face of the casing 40. On the bottom frame 42, disposed is the outdoor heat exchanger 11. Now the outdoor heat exchanger 11 is substantially U-shaped in plan view, and is faced to the rear face, and the left and right side faces of the casing 40, so as to substantially compose the rear face, and the left and right side faces of the casing 40.

Above the outdoor heat exchanger 11, disposed is the fan module 44 that composes a portion of the casing 40 above the front, rear, left, and right supports 43, and the top face of the casing 40. The fan module 44 is an assemblage having a substantially rectangular box with an opened top and an opened bottom, and the outdoor fan 15 housed therein. The opened top of the fan module 44 serves as a blow-out port 40*d*, and a blow-out grill 46 is provided to the blow-out port 40*d*. The outdoor fan 15 is disposed in the casing 40 while facing the blow-out port 40*d*, and serves as an air blower that incorporates air through the intake ports 40*a*, 40*b*, 40*c* into the casing 40, and outputs the air through the blow-out port 40*d*.

The front panel 45 is laid across the supports 43 on the front side, and composes the front face of the casing 40.

The casing 40 also houses refrigerant circuit components, other than the outdoor fan 15 and the outdoor heat exchanger 11 (FIG. 2 illustrates the accumulator 7, the compressor 8 and the refrigerant pipes 16 to 18). The compressor 8 and the accumulator 7 are disposed on the bottom frame 42.

As described above, the outdoor unit 2 has the casing 40 with the air intake ports 40*a*, 40*b*, 40*c* formed in the side faces (the rear face and the left and right side faces, herein), and with the air blow-out port 40*d* formed in the top face; the outdoor fan 15 disposed in the casing 40 while facing the blow-out port 40*d*; and the outdoor heat exchanger 11 disposed in the casing 40 and below the outdoor fan 15. In such top-blown-type unit structure having the outdoor heat exchanger 11 disposed below the outdoor fan 15, the flow velocity of the air that flows through the outdoor heat exchanger 11 tends to be larger in the upper part of the outdoor heat exchanger 11 than in the lower part of the outdoor heat exchanger 11 (see FIG. 3).

(3-2) Outdoor Heat Exchanger

The outdoor heat exchanger 11 is responsible for heat exchange between the refrigerant and the outdoor air, and mainly has a first header collecting pipe 80, a second header collecting pipe 90, a plurality of flat multi-hole tubes 63, and a plurality of fins 64. In this example, all of the first header collecting pipe 80, the second header collecting pipe 90, the flat multi-hole tubes 63 and the fins 64 are made of aluminum or an aluminum alloy, and joined together by brazing.

Both of the first header collecting pipe 80 and the second header collecting pipe 90 are members in the form of vertically long hollow cylinder. The first header collecting pipe 80 is attached to one end (herein, on the left front side in FIG. 4) of the outdoor heat exchanger 11 so as to stand vertically, meanwhile the second header collecting pipe 90 is attached to the other end (herein, on the right front side in FIG. 4) of the outdoor heat exchanger 11 so as to stand vertically.

Each flat multi-hole tube 63 has flat faces 63*a* that serve as a heat transfer surface and are faced vertically, and a large number of fine channels 63*b* through which the refrigerant flows. The flat multi-hole tubes 63 are arranged in line multiply in the vertical direction, and have both ends connected to the first header collecting pipe 80 and the second header collecting pipe 90. Note that the plurality of flat multi-hole tubes 63 in one or more embodiments are disposed at regular intervals according to a predetermined pitch in the vertical direction. Each fin 64 partitions a space between every adjacent flat multi-hole tubes 63 into a plurality of air flow paths through which the air flows, and has formed therein a plurality of slit-like notches 64*a* that extend horizontally, into which the plurality of flat multi-hole tubes 63 can be inserted. Each notch 64*a* of the fin 64 is shaped substantially identical to the outer profile of a cross-section of each flat multi-hole tube 63.

The outdoor heat exchanger 11 has the heat exchanging unit 60 that is composed of the flat multi-hole tubes 63 arranged in line multiply in the vertical direction, and the fins 64 fitted thereto. The heat exchanging unit 60 has an upper stage heat exchanging unit 60A on the upper stage side, and a lower stage heat exchanging unit 60B on the lower stage side.

The first header collecting pipe 80 has the inner space partitioned in the vertical direction, by a partition plate 81 that horizontally extends, into a gas-side inlet and outlet communication space 80A and a liquid-side inlet and outlet communication space 80B, which correspond to the upper stage heat exchanging unit 60A and the lower stage heat exchanging unit 60B, respectively. The gas-side inlet and outlet communication space 80A communicates with the flat multi-hole tubes 63 that compose the corresponding upper stage heat exchanging unit 60A. Meanwhile, the liquid-side inlet and outlet communication space 80B communicates with the flat multi-hole tubes 63 that compose the corresponding lower stage heat exchanging unit 60B.

To the gas-side inlet and outlet communication space 80A of the first header collecting pipe 80, also connected is a refrigerant pipe 19 (see FIG. 1) through which the refrigerant fed from the compressor 8, during the cooling operation, is allowed to pass towards the gas-side inlet and outlet communication space 80A.

Meanwhile, to the liquid-side inlet and outlet communication space 80B of the first header collecting pipe 80, also connected is a refrigerant pipe 20 (see FIG. 1) through which the refrigerant fed from the outdoor expansion valve 12, during the heating operation, is allowed to pass towards the liquid-side inlet and outlet communication space 80B.

The second header collecting pipe 90 has the inner space partitioned in the vertical direction individually by partition plates 91, 92, 93, 94 that horizontally extend, and also partitioned in the vertical direction by a diaphragm with nozzle 99 that is disposed between the partition plate 92 and the partition plate 93, consequently having first to third upper stage turnaround communication spaces 90A, 90B, 90C, and first to third lower stage turnaround communication spaces 90D, 90E, 90F, all being arranged in that order from the top to the bottom. The first to third upper stage turnaround communication spaces 90A, 90B, 90C communicate with the flat multi-hole tubes 63 in the corresponding upper stage heat exchanging unit 60A, meanwhile the first to third lower stage turnaround communication spaces 90D, 90E, 90F communicate with the flat multi-hole tubes 63 in the corresponding lower stage heat exchanging unit 60B. The third upper stage turnaround communication space 90C and the first lower stage turnaround communication space 90D, although being partitioned into up and down direction by the diaphragm with nozzle 99, vertically communicate with each other through a nozzle 99*a* provided so as to extend vertically through the diaphragm with nozzle 99. Meanwhile, the first upper stage turnaround communication space 90A and the third lower stage turnaround communication space 90F are connected by a first connection pipe 24 that is connected to the second header collecting pipe 90, and the second upper stage turnaround communication space 90B and the second lower stage turnaround communication space 90E are connected by a second connection pipe 25 that is connected to the second header collecting pipe 90. Both of the first connection pipe 24 and the second connection pipe 25 are cylindrical pipes, with a simple structure and high compressive strength. The first connection pipe 24 and the second connection pipe 25 make contact with the second header collecting pipe 90 on the side opposite to the side where the flat multi-hole tubes 63 are connected and extend horizontally.

When the thus composed outdoor heat exchanger 11 functions as an evaporator of refrigerant, the refrigerant, coming through the refrigerant pipe 20 and entering the liquid-side inlet and outlet communication space 80B of the first header collecting pipe 80, then flows through the flat multi-hole tubes 63 in the lower stage heat exchanging unit 60B connected to the liquid-side inlet and outlet communication space 80B, into the first to third lower stage turnaround communication spaces 90D, 90E, 90F of the second header collecting pipe 90. The refrigerant that has entered the first lower stage turnaround communication space 90D then flows through the nozzle 99*a* of the diaphragm with nozzle 99 into the third upper stage turnaround communication space 90C, and flows through the flat multi-hole tubes 63 in the upper stage heat exchanging unit 60A connected to the third upper stage turnaround communication space 90C, into the gas-side inlet and outlet communication space 80A of the first header collecting pipe 80. The refrigerant that has entered the second lower stage turnaround communication space 90E then flows through the second connection pipe 25 into the second upper stage turnaround communication space 90B, and flows through the flat multi-hole tubes 63 in the upper stage heat exchanging unit 60A connected to the second upper stage turnaround communication space 90B, into the gas-side inlet and outlet communication space 80A of the first header collecting pipe 80. The refrigerant that has entered the third lower stage turnaround communication space 90F then flows through the first connection pipe 24 into the first upper stage turnaround communication space 90A, and flows through the flat multi-hole tubes 63 in the upper stage heat exchanging unit 60A connected to the first upper stage turnaround communication space 90A, into the gas-side inlet and outlet communication space 80A of the first header collecting pipe 80. The refrigerant joined in the gas-side inlet and outlet communication space 80A of the first header collecting pipe 80 is then allowed to flow through the refrigerant pipe 19 to the outside of the outdoor heat exchanger 11. For the outdoor heat exchanger 11 used as a radiator of refrigerant, the aforementioned flow of refrigerant will be inverted.

(4) Internal Structure of First Upper Stage Turnaround Communication Space 90A, Etc.

Figure 8:
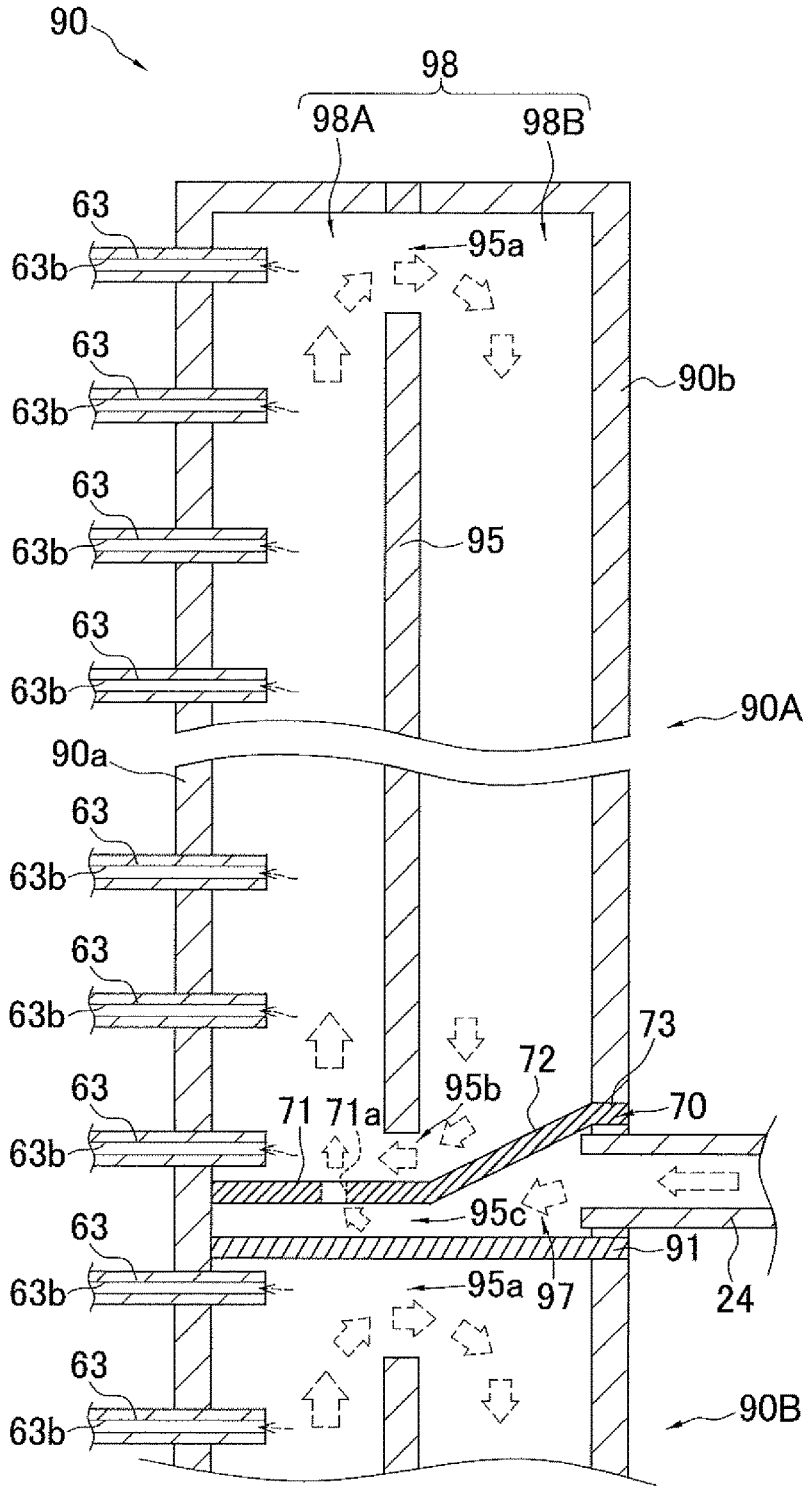
FIG. 8 is a schematic cross-sectional structure diagram, as viewed along an air flow direction, illustrating a structure in the vicinity of an upper end portion of a second header collecting pipe in the outdoor heat exchanger.
Figure 9:
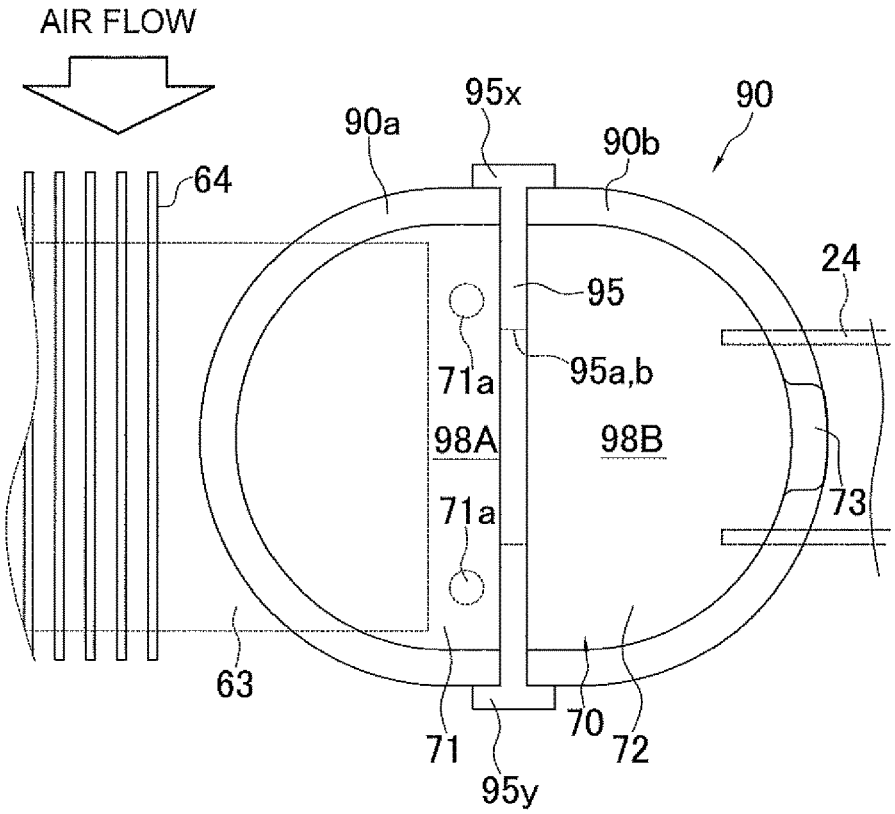
FIG. 9 is a schematic cross-sectional structure diagram, in a top view, illustrating a structure in the vicinity of the upper end portion of the second header collecting pipe in the outdoor heat exchanger.
Figure 10:
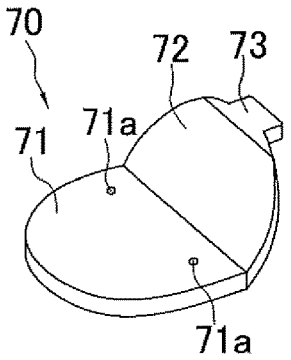
FIG. 10 is a schematic external perspective view of a partially inclined partitioning member with nozzle.
Figure 11:
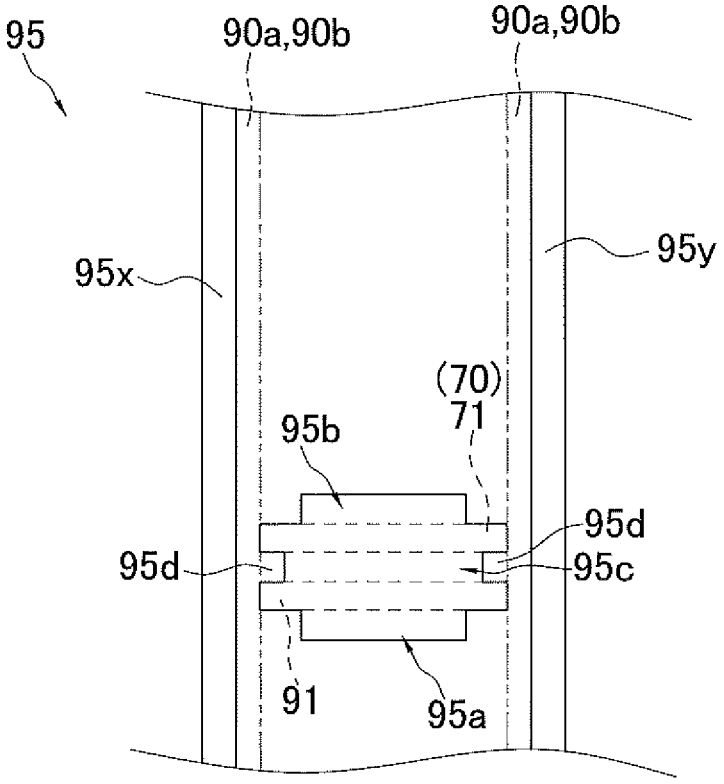
FIG. 11 is a schematic external view, from an insertion direction of the flat multi-hole tube, of a circulation diaphragm.

FIG. 8 is a schematic cross-sectional structure diagram, taken along an air flow direction, illustrating the first upper stage turnaround communication space 90A of the second header collecting pipe 90 in the outdoor heat exchanger 11. FIG. 9 is a schematic cross-sectional structure diagram, in a top view, illustrating the first upper stage turnaround communication space 90A of the second header collecting pipe 90 in the outdoor heat exchanger 11. FIG. 10 is a schematic external perspective view of a partially inclined partitioning member with nozzle 70. FIG. 11 is a schematic external view, from an insertion direction of the flat multi-hole tube 63, of a circulation diaphragm 95.

To the first upper stage turnaround communication space 90A, provided are the partially inclined partitioning member with nozzle 70 provided with the nozzle 71*a*, and the circulation diaphragm 95 that extends in the vertical direction and in the direction of air flow. The bottom of the first upper stage turnaround communication space 90A is covered with the partition plate 91. The partition plate 91 is a plate-shaped member having a uniform thickness, a substantially circular shape that extends in the horizontal direction, no inclined portion, and a simple structure, like the other partition plates 92, 93, and 94.

The second header collecting pipe 90 is composed, as illustrated in FIG. 9, so that a first header structural member 90*a* having in a top view a substantially arcuate shape convex towards the flat multi-hole tubes 63, and a second header structural member 90*b* having in a top view a substantially arcuate shape convex towards the opposite side of the flat multi-hole tubes 63, clamp the circulation diaphragm 95 in between, in the direction the flat multi-hole tubes 63 are inserted (thickness direction of the circulation diaphragm 95). Now the circulation diaphragm 95 has, on the upwind end, an upwind end part 95*x* that is widened in the thickness direction, and has, on the downwind end, a downwind end part 95*y* that is widened in the thickness direction, wherein these end parts clamp the first header structural member 90*a* and the second header structural member 90*b* in between from the outside in the direction of air flow, and are fixed by blazing.

The partially inclined partitioning member with nozzle 70 partitions the first upper stage turnaround communication space 90A vertically, into a circulation space 98 that is positioned on the upper side, and an introduction space 97 that is positioned on the lower side. The partially inclined partitioning member with nozzle 70 is, as illustrated in FIG. 9, an integrated member composed of a nozzle forming part 71, an inclined part 72, and a fixable end part 73. By constructing the partially inclined partitioning member with nozzle 70 as an integrated member, the number of components can be reduced. The introduction space 97 is surrounded from the top and the bottom by the partially inclined partitioning member with nozzle 70 and the partition plate 91 both provided in the first upper stage turnaround communication space 90A, and has the end of the first connection pipe 24 connected to the side opposite to the flat multi-hole tubes 63. In one or more embodiments, the flat multi-hole tube 63 is not connected to the introduction space 97.

The nozzle forming part 71 has a plate-shaped flat part that extends horizontally, and has nozzles 71*a* that extend through the thickness direction (vertical direction) on the upstream side and on the downstream side. A part of the nozzle forming part 71 has a semi-arcuate profile in a top view, placed in contact with, and brazed to, a substantially semi-arcuate inner circumferential face of the first header structural member 90*a*. A portion, on the side opposite to the flat multi-hole tubes 63, of the nozzle forming part 71 is disposed so as to extend through the circulation diaphragm 95 in the thickness direction, and is supported from the top and bottom while being held in between, by a surrounding part of the circulation diaphragm 95 (a support projection 95*d* and both side parts of a lower communication slot 95*b*, described later). The nozzle forming part 71 is positioned so as to mainly overlap an upflow space 98A in a plan view.

The inclined part 72 is a plate-shaped part that extends so as to be continued from a part, on the side opposite to the flat multi-hole tubes 63, of the nozzle forming part 71, and has an inclined face that inclines upward in the direction away from the flat multi-hole tubes 63 as extending toward the side opposite from the flat multi-hole tubes 63 side. Also the inclined part 72 has a part with a semi-arcuate profile, placed in contact with, and brazed to, a substantially semi-arcuate inner circumferential face of the second header structural member 90*b*. The inclined part 72 is positioned so as to mainly overlap a downflow space 98B in a plan view.

The fixable end part 73 extends continuously from a part, on the side opposite to the flat multi-hole tubes 63, of the inclined part 72, and has a plate-shaped flat part that extends in the horizontal direction. The fixable end part 73 is positioned in an opening provided in the second header structural member 90*b*, and is brazed while being surrounded by the opening from the top, bottom, front, and rear sides.

Also above the partition plate 92 that composes the bottom of the second upper stage turnaround communication space 90B, provided is the partially inclined partitioning member with nozzle 70 having a structure same as described above.

For the manufacturing, the partially inclined partitioning member with nozzle 70 is preliminarily inserted, together with the partition plates 91, 92, into the openings for insertion provided to the circulation diaphragm 95, and then sandwiched by the first header structural member 90*a* and the second header structural member 90*b*.

The circulation diaphragm 95 is disposed in the first upper stage turnaround communication space 90A, in a space above the partially inclined partitioning member with nozzle 70, so as to extend in the vertical direction and in the direction of air flow. The circulation diaphragm 95 partitions inside the circulation space 98, into the upflow space 98A that has the flat multi-hole tubes 63 connected thereto and operates to bring up the refrigerant when used in an evaporator mode, and the downflow space 98B that operates to bring down the refrigerant when used in an evaporator mode. The circulation diaphragm 95 also partitions the second and third upper stage turnaround communication spaces 90B, 90C in the same way, into the upflow space 98A and the downflow space 98B. That is, the circulation diaphragm 95 is composed of a vertically joined integrated plate-shaped member in the first to third upper stage turnaround communication spaces 90A, 90B, 90C.

The nozzle 71*a* provided to the nozzle forming part 71 of the partially inclined partitioning member with nozzle 70 is positioned so as to communicate with the upflow space 98A, that is, at a position that overlaps the upflow space 98A in a plan view.

The circulation diaphragm 95, disposed in the circulation space 98 of the first upper stage turnaround communication space 90A, has an upper communication slot 95*a* that extends through in the thickness direction in an upper zone of the circulation space 98, and has a lower communication slot 95*b* that extends through in the thickness direction in a lower zone of the circulation space 98. In the introduction space 97 below the partially inclined partitioning member with nozzle 70 in the first upper stage turnaround communication space 90A, the circulation diaphragm 95 has a connection slot 95*c* provided so as to extend through in the thickness direction. Now all of the end parts of the flat multi-hole tubes 63 connected to the second header collecting pipe 90 are positioned within the upflow space 98A, without reaching the circulation diaphragm 95.

The upper communication slot 95*a*, the lower communication slot 95*b*, and the connection slot 95*c* are also provided in the same way to the second upper stage turnaround communication space 90B, meanwhile the upper communication slot 95*a* and the lower communication slot 95*b* are provided to the third upper stage turnaround communication space 90C.

Now as illustrated in FIG. 11, in a portion of the circulation diaphragm 95 that extends across the second upper stage turnaround communication space 90B and the first upper stage turnaround communication space 90A, there are formed side by side, in the order from the bottom to the top, the upper communication slot 95*a* for the second upper stage turnaround communication space 90B, the connection slot 95*c* for the first upper stage turnaround communication space 90A, and the lower communication slot 95*b* for the first upper stage turnaround communication space 90A. The upper communication slot 95*a* for the second upper stage turnaround communication space 90B and the connection slot 95*c* for the first upper stage turnaround communication space 90A are joined, while placing in between an opening into which the partition plate 91 is inserted and fixed. Meanwhile, the connection slot 95*c* for the first upper stage turnaround communication space 90A and the lower communication slot 95*b* for the first upper stage turnaround communication space 90A are joined, while placing in between an opening into which the nozzle forming part 71 of the partially inclined partitioning member with nozzle 70 is inserted and fixed. As illustrated in FIG. 11, the opening for insertion and fixation of the partition plate 91 and the opening for insertion and fixation of the nozzle forming part 71 of the partially inclined partitioning member with nozzle 70 extend to reach the first header structural member 90*a* and the second header structural member 90*b* of the second header collecting pipe 90, in the direction of air flow from the upstream side towards the downstream side. All of the upper communication slot 95*a* for the second upper stage turnaround communication space 90B, the connection slot 95*c* for the first upper stage turnaround communication space 90A, and the lower communication slot 95*b* for the first upper stage turnaround communication space 90A extend to right in front of the first header structural member 90*a* and the second header structural member 90*b* of the second header collecting pipe 90. The connection slot 95*c* for the first upper stage turnaround communication space 90A has support projections 95*d* provided so as to protrude from an upwind end part and from a downwind end part, respectively, towards the downwind side and the upwind side. Hence, the nozzle forming part 71 of the partially inclined partitioning member with nozzle 70 is held in the vertical direction, from the top by preceding and succeeding parts, in the direction of air flow, of the lower communication slot 95*b* for the first upper stage turnaround communication space 90A, and is supported from the bottom by top end parts of the support projections 95*d*. The partition plate 91 is held in the vertical direction, from the top by the bottom end parts of the support projections 95*d*, and is supported from the bottom by preceding and succeeding parts, in the direction of air flow, of the upper communication slot 95*a* for the second upper stage turnaround communication space 90B. Hence, the lower end part of the lower communication slot 95*b* for the first upper stage turnaround communication space 90A is composed of the top face of the nozzle forming part 71 of the partially inclined partitioning member with nozzle 70 (the top face of a part, on the side opposite to the flat multi-hole tubes 63 relative to the nozzles 71*a*). The connection slot 95*c* for the first upper stage turnaround communication space 90A is composed of the bottom face of the nozzle forming part 71 of the partially inclined partitioning member with nozzle 70 (the bottom face of a part, on the side opposite to the flat multi-hole tubes 63 relative to the nozzles 71*a*), the top face of the partition plate 91, and the individual support projections 95*d*. Moreover, the upper end part of the upper communication slot 95*a* for the second upper stage turnaround communication space 90B is composed of the bottom face of the partition plate 91.

Owing to the structure, the introduction space 97, which is surrounded from the top and the bottom by the partially inclined partitioning member with nozzle 70 and the partition plate 91 disposed in the first upper stage turnaround communication space 90A, is formed so as to become narrower in the vertical direction as it approaches the side the flat multi-hole tubes 63 are connected, since the partition plate 91 extends horizontally, whereas the partially inclined partitioning member with nozzle 70 has provided thereto the inclined part 72. Provision of the inclined part 72 to the partially inclined partitioning member with nozzle 70 can make the introduction space 97 gradually narrowed in the vertical direction, from the first connection pipe 24 towards a part below the nozzles 71*a*, rather than sharply narrowed. Hence, the refrigerant can be suppressed from being affected by sudden pressure loss, when the refrigerant that comes through the first connection pipe 24 into the introduction space 97 moves in the introduction space 97 towards the part below the nozzles 71*a*.

In one or more embodiments, the outer diameter of the first connection pipe 24 is larger than the vertical interval of the plurality of flat multi-hole tubes 63, and is larger than the vertical distance in the introduction space 97, measured between the nozzle forming part 71 of the partially inclined partitioning member with nozzle 70 and the partition plate 91. The lower end of a flat multi-hole tube 63 closest to the nozzles 71*a* (nearest from the nozzles 71*a*), out of the plurality of flat multi-hole tubes 63, is positioned below the top end of the end part, on the side of connection to the first upper stage turnaround communication space 90A, of the first connection pipe 24. Such dimensional and positional relations of the first connection pipe 24 are also applicable to the second connection pipe 25 connected to the introduction space 97 of the second upper stage turnaround communication space 90B.

Both of the nozzle forming part 71 of the partially inclined partitioning member with nozzle 70, and the partition plate 91, which are disposed in the first upper stage turnaround communication space 90A, are placed between the vertically arranged flat multi-hole tubes 63.

(5) Flow of Refrigerant in First Upper Stage Turnaround Communication Space 90A Flow of refrigerant in the first upper stage turnaround communication space 90A, when the outdoor heat exchanger 11 in the aforementioned structure is used as an evaporator of refrigerant, will be explained below.

The refrigerant that comes through the first connection pipe 24 into the introduction space 97 below the partially inclined partitioning member with nozzle 70 partially moves below the upflow space 98A, and is then blown up through the nozzles 71*a* in the nozzle forming part 71 of the partially inclined partitioning member with nozzle 70, into the upflow space 98A. Since there is no flat multi-hole tube 63 connected to the introduction space 97, the refrigerant does not flow from the introduction space 97 directly into the flat multi-hole tube 63.

The refrigerant fed into the upflow space 98A ascends in the upflow space 98A, during which the refrigerant is distributed into the flat multi-hole tubes 63 connected at every level of height. The refrigerant, upon reaching the top end or around of the upflow space 98A, is then fed through the upper communication slot 95*a* of the circulation diaphragm 95 into the downflow space 98B, and descends in the downflow space 98B.

The refrigerant coming down in the downflow space 98B then descends at around the bottom end of the downflow space 98B, along the top face of the inclined part 72 of the partially inclined partitioning member with nozzle 70 towards the flat multi-hole tubes 63. The refrigerant thus descended in the downflow space 98B is guided through the lower communication slot 95*b* of the circulation diaphragm 95 again into the upflow space 98A. The refrigerant can circulate in the circulation space 98 in this way.

The structure and flow of refrigerant in the second upper stage turnaround communication space 90B are same as the structure and flow of refrigerant in the first upper stage turnaround communication space 90A, and will not be explained again.

Although the structure and flow of refrigerant in the third upper stage turnaround communication space 90C are different from the first upper stage turnaround communication space 90A, in that the partially inclined partitioning member with nozzle 70 in the first upper stage turnaround communication space 90A corresponds to the diaphragm with nozzle 99 that composes the lower end of the third upper stage turnaround communication space 90C, the other structure and flow of refrigerant remain identical, so that the explanation will be skipped.

(6) Features 6-1

The outdoor heat exchanger 11 according to one or more embodiments is designed to blow up the refrigerant through the nozzles 71*a* provided to the nozzle forming part 71 of the partially inclined partitioning member with nozzle 70 to make the refrigerant ascend in the upflow space 98A of the circulation space 98. Hence, even if the outdoor heat exchanger 11 is operated at a low volume of circulation of the refrigerant, a sufficient volume of the refrigerant may be fed also to the flat multi-hole tubes 63 that are connected to the upper part of the first upper stage turnaround communication space 90A of the second header collecting pipe 90 (the same will apply to the second upper stage turnaround communication space 90B).

When the volume of circulation of refrigerant increases in the outdoor heat exchanger 11, the refrigerant can ascend vigorously in the upflow space 98A, and the refrigerant accumulated in the upper part of the upflow space 98A can be circulated through the upper communication slot 95*a*, the downflow space 98B, and the lower communication slot 95*b*, back into the upflow space 98A again.

In this way, even if the volume of circulation of refrigerant varies, the refrigerant may equally be distributed into the flat multi-hole tubes 63 connected at every level of height, making it possible to suppress the unequal flow of refrigerant among the plurality of flat multi-hole tubes 63.

6-2

A heat exchanger according to one or more embodiments has the structure in which the refrigerant is fed through the first connection pipe 24 into the first upper stage turnaround communication space 90A of the second header collecting pipe 90, where the first connection pipe 24 in which the refrigerant before being distributed is allowed to flow (or, in which the refrigerant after being joined is allowed to flow, when operated as a condenser) tends to have a large outer diameter.

Hence, in the heat exchanger according to aforementioned embodiments, the first connection pipe 24 has an outer diameter which is larger than the vertical distance in the introduction space 97, measured between the nozzle forming part 71 of the partially inclined partitioning member with nozzle 70 and the partition plate 91, and is also larger than the vertical interval of the flat multi-hole tubes 63. The top end of the first connection pipe 24 is positioned above the lower end of the flat multi-hole tube 63 right above the nozzle 71*a*.

Figure 18:
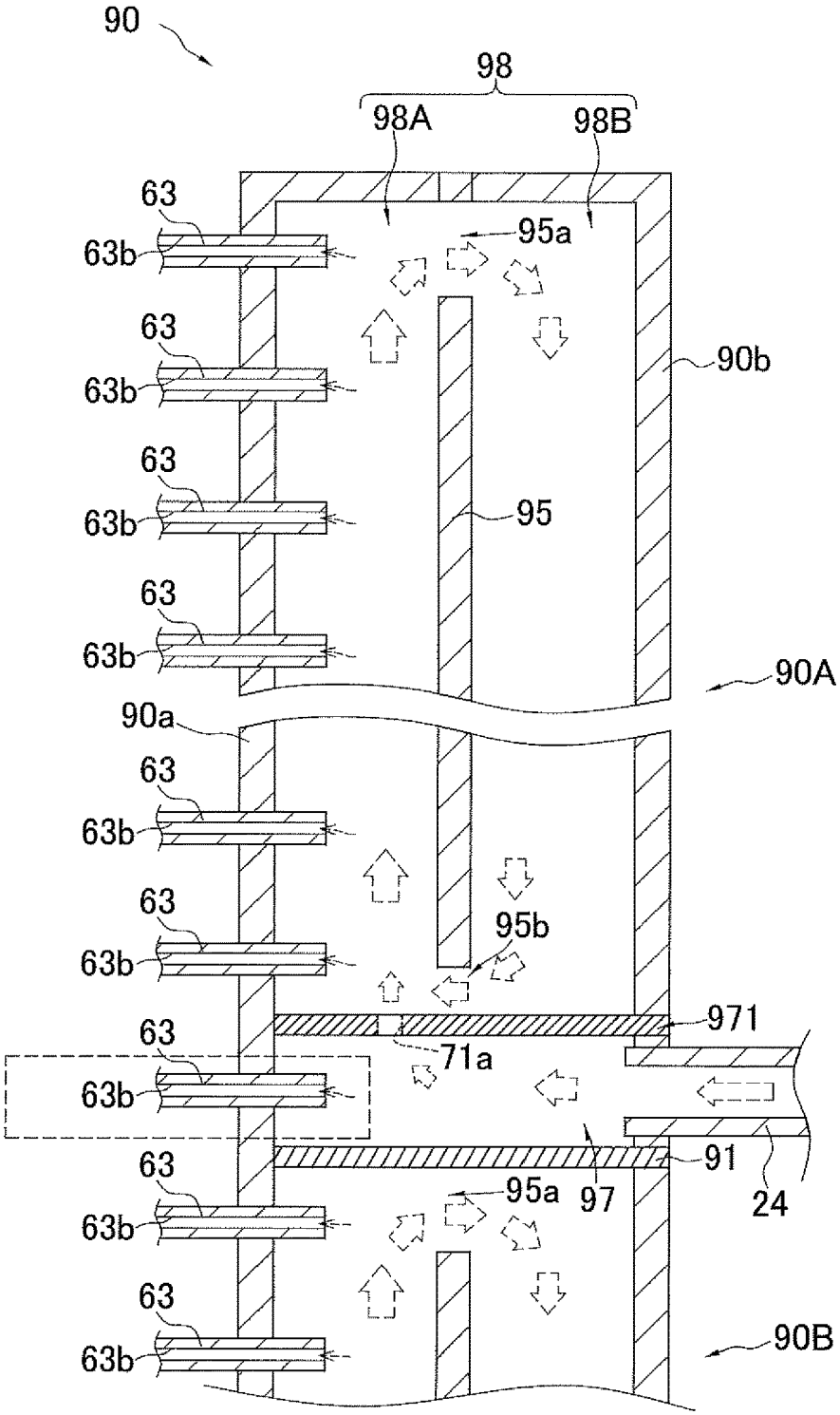
FIG. 18 is a schematic cross-sectional structure diagram, as viewed along an air flow direction, illustrating a structure in the vicinity of an upper end portion of a second header collecting pipe in an outdoor heat exchanger according to Reference Example.

Assuming, in this case, that both of the partition plate 91 and a diaphragm with nozzle 971 that compose the top face and the bottom face of the introduction space 97 are composed of horizontally extended members as illustrated in FIG. 18, then the vertical width of the introduction space 97 on the side closer to the flat multi-hole tubes 63 tends to increase. Hence, if the flat multi-hole tubes 63 are disposed vertically at regular intervals, the introduction space 97 would have the flat multi-hole tube 63 connected thereto. If so, the flat multi-hole tube 63 connected to the introduction space 97 below the diaphragm with nozzle 971 (the flat multi-hole tube 63 surrounded by a dotted line in FIG. 18) would have a larger volume of refrigerant intensively flowed thereto, as compared with the flat multi-hole tube 63 connected to the upper circulation space 98 above the diaphragm with nozzle 971 (since pressure loss appears at the nozzles 71*a* of the diaphragm with nozzle 971, to create difference in pressure of the refrigerant between the upstream side and downstream side of the nozzles 71*a*). This consequently causes the unequal flow of refrigerant among the plurality of flat multi-hole tubes 63. Such unequal flow, if caused, would cause variation in the state of refrigerant that flows through each of the plurality of flat multi-hole tubes 63 (since, for example, a part of the flat multi-hole tubes 63 would have a long path through which the dry-out refrigerant flows, whereas another part of the flat multi-hole tubes 63 would allow unvaporized refrigerant to flow), possibly making the outdoor heat exchanger 11 unable to fully demonstrate the performance. On the other hand, if the introduction space 97 is designed to have no flat multi-hole tube 63 connected thereto (omission of the flat multi-hole tube 63 surrounded by the dotted line in FIG. 18), a certain number of flat multi-hole tube(s) 63 used for a range corresponding to such large diameter of the first connection pipe 24 will be lost. This consequently reduces the number of flat multi-hole tube(s) 63, and degrades the performance of the outdoor heat exchanger 11. The number of flat multi-hole tubes 63 might be compensated by adding the flat multi-hole tubes 63, having been omitted, above the circulation space 98. This, however, enlarges the outdoor heat exchanger 11 in the vertical direction.

In contrast, the outdoor heat exchanger 11 according to one or more embodiments, constructed so that the refrigerant is fed through the first connection pipe 24 into the first upper stage turnaround communication space 90A of the second header collecting pipe 90, makes it possible to narrow the vertical width of a space below the nozzles 71*a* in the introduction space 97, as compared with the space on the side where the first connection pipe 24 is connected, by using the partially inclined partitioning member with nozzle 70 having the inclined part 72, even if the first connection pipe 24 has an outer diameter larger than the vertical interval of the flat multi-hole tubes 63; even if the first connection pipe 24 has an outer diameter larger than the vertical distance in the introduction space 97, measured between the nozzle forming part 71 of the partially inclined partitioning member with nozzle 70 and the partition plate 91; or even if the top end of the first connection pipe 24 is positioned above the lower end of the flat multi-hole tube 63 that resides right above the nozzles 71*a*.

This makes it possible to narrow the vertical width of the introduction space 97 on the side closer to the flat multi-hole tubes 63, to thereby reduce the number of flat multi-hole tubes 63 to be connected to the introduction space 97.

In particular, a heat exchanger according to one or more embodiments has a structure in which the flat multi-hole tubes 63 are connected only to the circulation space 98 of the first upper stage turnaround communication space 90A, but not connected to the introduction space 97. Thus it becomes possible to sufficiently suppress the unequal flow of refrigerant among the plurality of flat multi-hole tubes 63.

Even for the purpose of suppressing the unequal flow, it is no longer necessary to omit the flat multi-hole tube 63 or to add the flat multi-hole tube 63 to the circulation space 98, making it possible to avoid performance degradation, and enlargement of the outdoor heat exchanger 11.

(7) Modified Examples

While the aforementioned embodiments have explained exemplary cases, the embodiments by no means limit the present invention, and the present invention is not limited to the embodiments. The present invention also encompasses any embodiments modified without departing from the spirit, as a matter of course.

(7-1) Modified Example A

The aforementioned embodiments have been explained, referring to a case where the partially inclined partitioning member with nozzle 70, having the nozzle forming part 71 and the inclined part 72, is composed of an integrated member.

Figure 12:
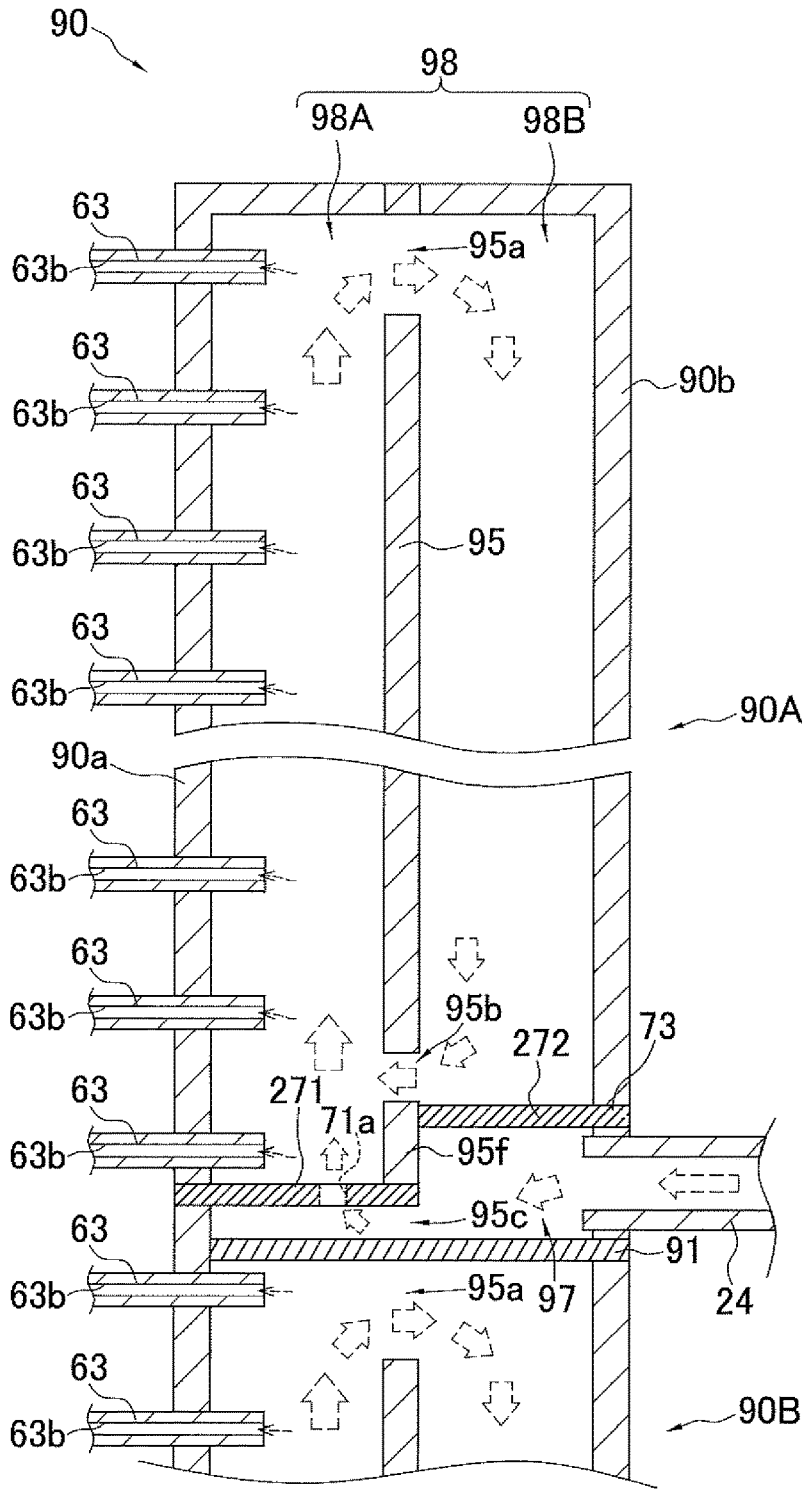
FIG. 12 is a schematic cross-sectional structure diagram, as viewed along an air flow direction, illustrating a structure in the vicinity of an upper end portion of a second header collecting pipe in an outdoor heat exchanger according to Modified Example A.

However, as illustrated in FIG. 12, the partitioning member may alternatively be composed in a separate manner, using a nozzle forming member 271 that is provided so as to compose the bottom face of the upflow space 98A, and a guide member 272 that is provided so as to compose the bottom face of the downflow space 98B at a level higher than the nozzle forming member 271.

Now, an upper connection part 95*f*, which is a part of the circulation diaphragm 95 and composes a portion below the lower communication slot 95*b*, is provided so as to vertically connect a part, on the side opposite to the flat multi-hole tubes 63, of the nozzle forming member 271, and a part, on the side closer to the flat multi-hole tubes 63, of the guide member 272. In such structure, the refrigerant that flows through the first connection pipe 24 into the introduction space 97 is guided towards the zone below the nozzles 71*a* stepwisely, rather than continuously.

Such structure, having the nozzle forming member 271 and the guide member 272 connected with the upper connection part 95*f*, is more likely to cause pressure loss, as compared with the partially inclined partitioning member with nozzle 70 in the aforementioned embodiments, since the refrigerant coming through the first connection pipe 24 into the introduction space 97 can strongly collide on the connection part 95*f*. Considering now that the partially inclined partitioning member with nozzle 70 in the aforementioned embodiments can moderate the collision, the partially inclined partitioning member with nozzle 70 in the aforementioned embodiments may be used.

Contrary to the description above, and although not illustrated, for example, the upper end of the introduction space 97 may be composed of a horizontally extending plate-shaped member with the nozzles 71*a* formed therein; and the lower end of the introduction space may be composed of a flat tube-side bottom part that is disposed so as to horizontally extend on the side the flat multi-hole tubes 63 are connected, an opposite-multi-hole tube-side bottom part that is disposed so as to extend horizontally at a level of height lower than the flat tube-side bottom part, and on the side opposite to the side the flat multi-hole tubes 63 are connected, and a lower connection part that is a part of the circulation diaphragm 95, composing an upper part of the upper communication slot 95*a* positioned below the introduction space 97, and vertically connecting a part, on the side opposite to the flat multi-hole tubes 63, of the flat tube-side bottom part, and a part, on the side closer to the flat multi-hole tubes 63, of the opposite-multi-hole tube-side bottom part.

Still alternatively, the introduction space 97 may be formed by all of the nozzle forming member 271, the guide member 272, the upper connection part 95*f*, the flat tube-side bottom part, the opposite-multi-hole tube-side bottom part, and the lower connection part.

(7-2) Modified Example B

The aforementioned embodiments have been explained, referring to a case where the upper end of the introduction space 97 is composed of the partially inclined partitioning member with nozzle 70 having the inclined part 72, and the lower end of the introduction space 97 is composed of the partition plate 91 that extends horizontally.

Figure 13:
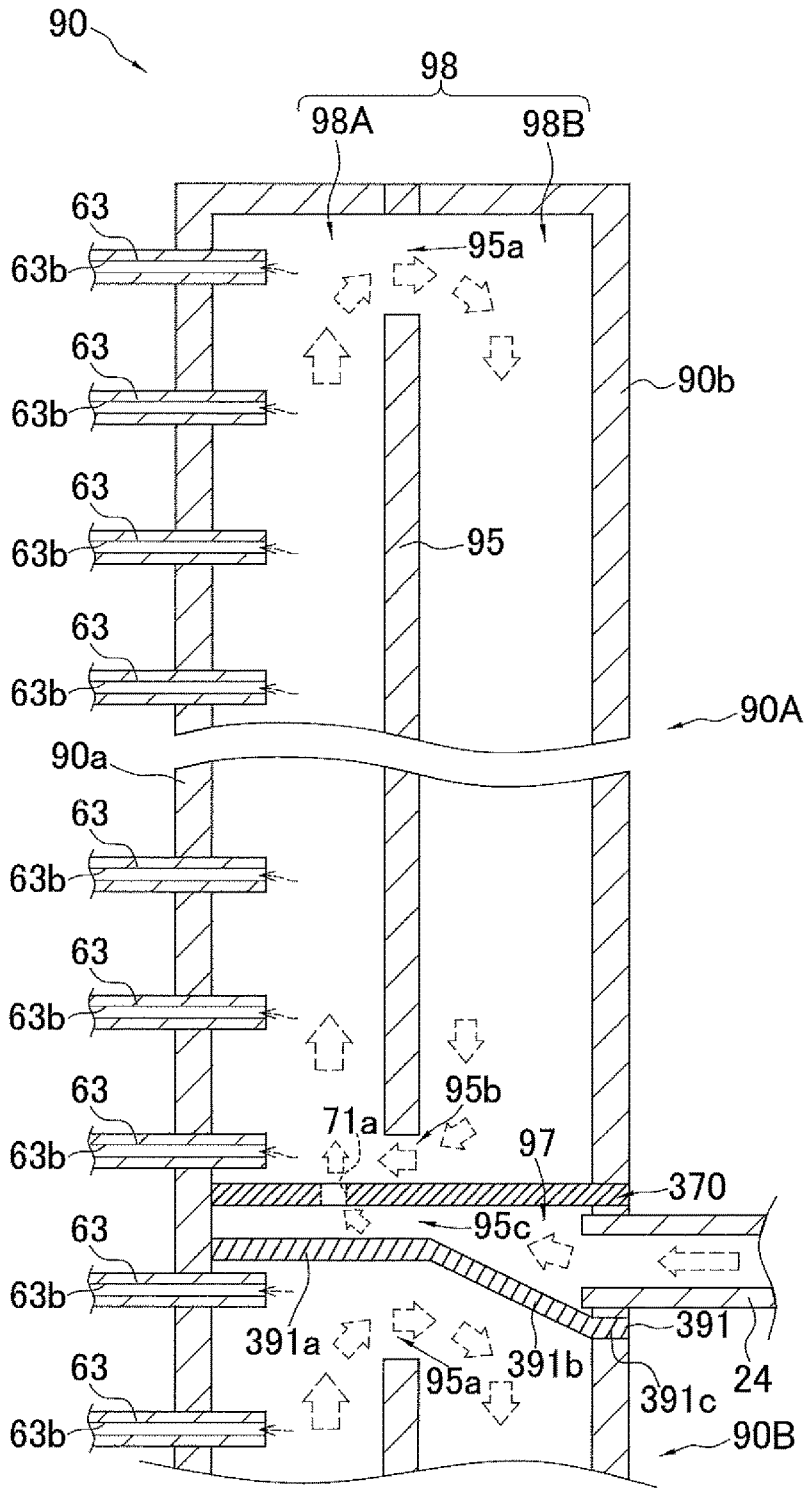
FIG. 13 is a schematic cross-sectional structure diagram, as viewed along an air flow direction, illustrating a structure in the vicinity of an upper end portion of a second header collecting pipe in an outdoor heat exchanger according to Modified Example B.

The introduction space 97 may alternatively be formed, as illustrated in FIG. 13, by a diaphragm with nozzle 370 that has the nozzles 71*a* and extends horizontally so as to compose the upper end of the introduction space 97, and a partially inclined partitioning member 391 that composes the lower end of the introduction space 97.

The partially inclined partitioning member 391 has a horizontal partition part 391*a*, a declined part 391*b*, and a fixable end part 391*c*. The horizontal partition part 391*a* is disposed on the side closer to the flat multi-hole tubes 63 (the side closer to the upflow space 98A) and extends horizontally. The declined part 391*b* protrudes out from the horizontal partition part 391*a* from the side opposite to the flat multi-hole tubes 63, and declines so as to be positioned lower as it approaches the side opposite to the flat multi-hole tubes 63. The fixable end part 391*c* is joined to the declined part 391*b* on the side opposite to the flat multi-hole tubes 63, and is fixed by insertion into a corresponding opening provided to the second header structural member 90*b*.

Also this structure, even with the first connection pipe 24 having a large diameter, can demonstrate effects same as those in the aforementioned embodiments.

The structure also makes it possible to guide the refrigerant that comes through the first connection pipe 24 into the introduction space 97 towards a zone just below the nozzles 71*a*, as a result of provision of the declined part 391*b* in an inclined manner, even if the level of height of the lower end of the first connection pipe 24 in the introduction space 97 overlaps the level of height of the flat multi-hole tube 63 positioned just below the horizontal partition part 391*a*, or comes even below the flat multi-hole tube 63 positioned just below the horizontal partition part 391*a*.

The declined part 391*b* of the partially inclined partitioning member 391 is smoothly joined at the end on the side of the flat multi-hole tubes 63 of the declined part 391*b*, to the horizontal partition part 391*a* at the end on the side opposite to the flat multi-hole tubes 63, at the same level of height. Hence, the refrigerant that flows through the upper communication slot 95*a* in the circulation space 98 positioned below the introduction space 97 is less susceptible to transmission resistance.

(7-3) Modified Example C

The aforementioned embodiments have been explained, referring to a case where the upper end of the introduction space 97 is composed of the partially inclined partitioning member with nozzle 70 having the inclined part 72, and the lower end of the introduction space 97 is composed of the partition plate 91 that extends horizontally.

Figure 14:
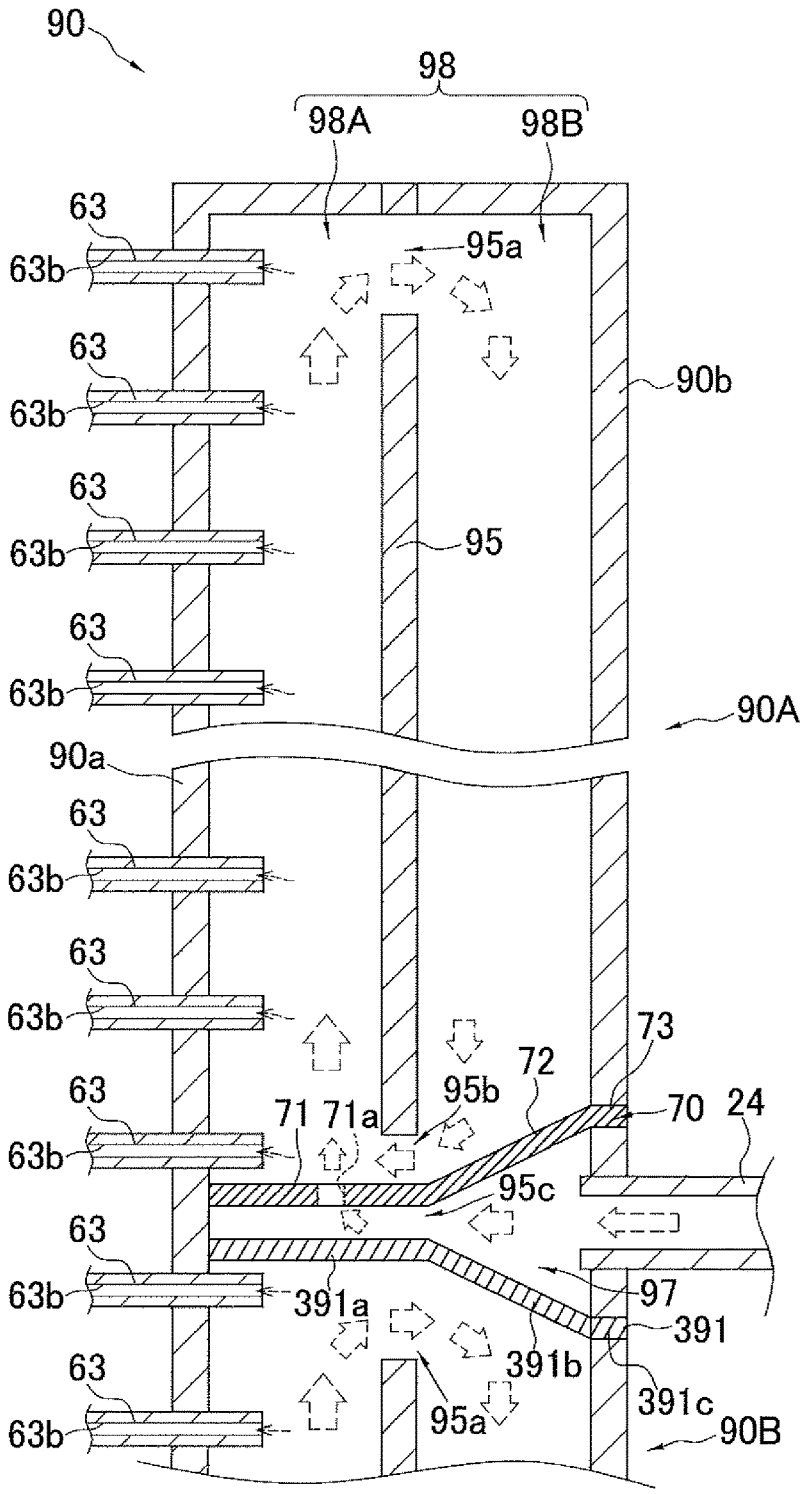
FIG. 14 is a schematic cross-sectional structure diagram, as viewed along an air flow direction, illustrating a structure in the vicinity of an upper end portion of a second header collecting pipe in an outdoor heat exchanger according to Modified Example C.
Figure 15:
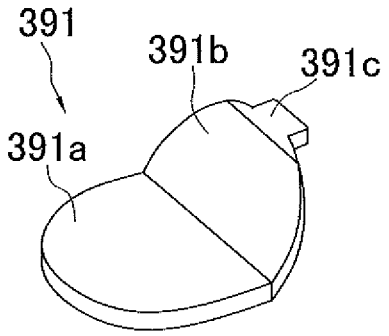
FIG. 15 is a schematic external perspective view of a partially inclined partitioning member.

In contrast, for example, the introduction space 97 may be designed, as illustrated in FIG. 14, by composing the upper end of the introduction space 97 with the partially inclined partitioning member with nozzle 70 which is same as that in the aforementioned embodiments, and by composing the lower end of the introduction space 97 with the partially inclined partitioning member 391 described in Modified Example B, while aligning the axis of the first connection pipe 24 at the center, in the vertical direction, of a zone between the inclined part 72 of the partially inclined partitioning member with nozzle 70 and the declined part 391*b* of the partially inclined partitioning member 391. In this case, manufacturing cost may be reduced by using the partially inclined partitioning member 391 with a shape illustrated in FIG. 15, which is identical to the partially inclined partitioning member with nozzle 70 except for the absence of the nozzles 71*a*.

In such structure, the inclined part 72 of the partially inclined partitioning member with nozzle 70 extends so as to be positioned higher as it approaches the side opposite to the side the flat multi-hole tubes 63 are connected to the second header collecting pipe 90, and the nozzle forming part 71 is joined to the inclined part 72 at the lowest point, so that it now becomes possible to elevate the upper limit level, in the vertical direction, of the first connection pipe 24 to be connected to the introduction space 97, and to bring down the upper limit level, in the vertical direction, of a zone in the introduction space 97 on the side where the flat multi-hole tubes 63 are connected. In addition, the declined part 391*b* of the partially inclined partitioning member 391 extends so as to be positioned lower as it approaches the side opposite to the side the flat multi-hole tubes 63 are connected to the second header collecting pipe 90, and the horizontal partition part 391*a* is joined to the declined part 391*b* at the highest point, so that it now becomes possible to bring down the lower limit level, in the vertical direction, of the first connection pipe 24 to be connected to the introduction space 97, and to elevate the lower limit level, in the vertical direction, of a zone in the introduction space 97 on the side where the flat multi-hole tubes 63 are connected. Hence, even if the first connection pipe 24 connectable to the introduction space 97 has a large outer diameter (for example, if the outer circumferential width, in the vertical direction, of the first connection pipe 24 is equal to or larger than the vertical distance between the adjacent flat multi-hole tubes 63), it now becomes possible to prevent the flat multi-hole tubes 63, vertically arranged at regular intervals, from being connected to the introduction space 97, or to reduce the number of the flat multi-hole tubes 63 to be connected.

Also, in the introduction space 97, since the center axis of the first connection pipe 24 is aligned at the center, in the vertical direction, of the zone surrounded by the inclined part 72 of the partially inclined partitioning member with nozzle 70 and the declined part 391*b* of the partially inclined partitioning member 391, so that much of the refrigerant introduced through the first connection pipe 24 into the introduction space 97 may be fed into the zone surrounded by the nozzle forming part 71 of the partially inclined partitioning member with nozzle 70 and the horizontal partition part 391*a* of the partially inclined partitioning member 391, while suppressing collision on the inclined part 72 of the partially inclined partitioning member with nozzle 70 and on the declined part 391*b* of the partially inclined partitioning member 391. This successfully reduces pressure loss possibly caused by the collision of the refrigerant flow to the inclined part 72 of the partially inclined partitioning member with nozzle 70 and on the declined part 391*b* of the partially inclined partitioning member 391.

(7-4) Modified Example D

The aforementioned embodiments have been explained referring to the structure of the outdoor heat exchanger 11 used as an evaporator, in which the refrigerant after flowing through the lower stage heat exchanging unit 60B on the lower stage side and before being fed into the upper stage heat exchanging unit 60A on the upper stage is distributed into the flat multi-hole tubes 63 at the individual levels of height (first upper stage turnaround communication space 90A, second upper stage turnaround communication space 90B, and third upper stage turnaround communication space 90C), while blowing up the refrigerant by using the nozzles 71*a*.

The embodiments, however, do not limit a site in the outdoor heat exchanger 11, capable of using such structure, in which the refrigerant is blown up by using the nozzles 71*a* to be distributed into the flat multi-hole tubes 63 connected at the individual levels of height.

Figure 16:
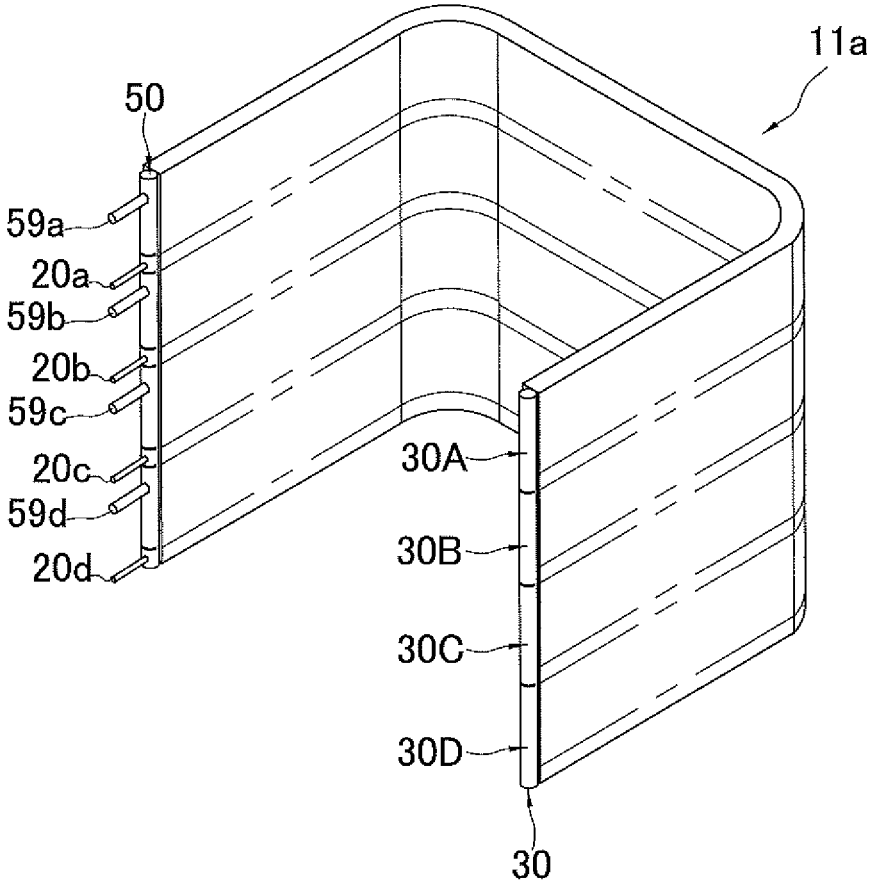
FIG. 16 is a schematic perspective view of an outdoor heat exchanger according to Modified Example D.
Figure 17:
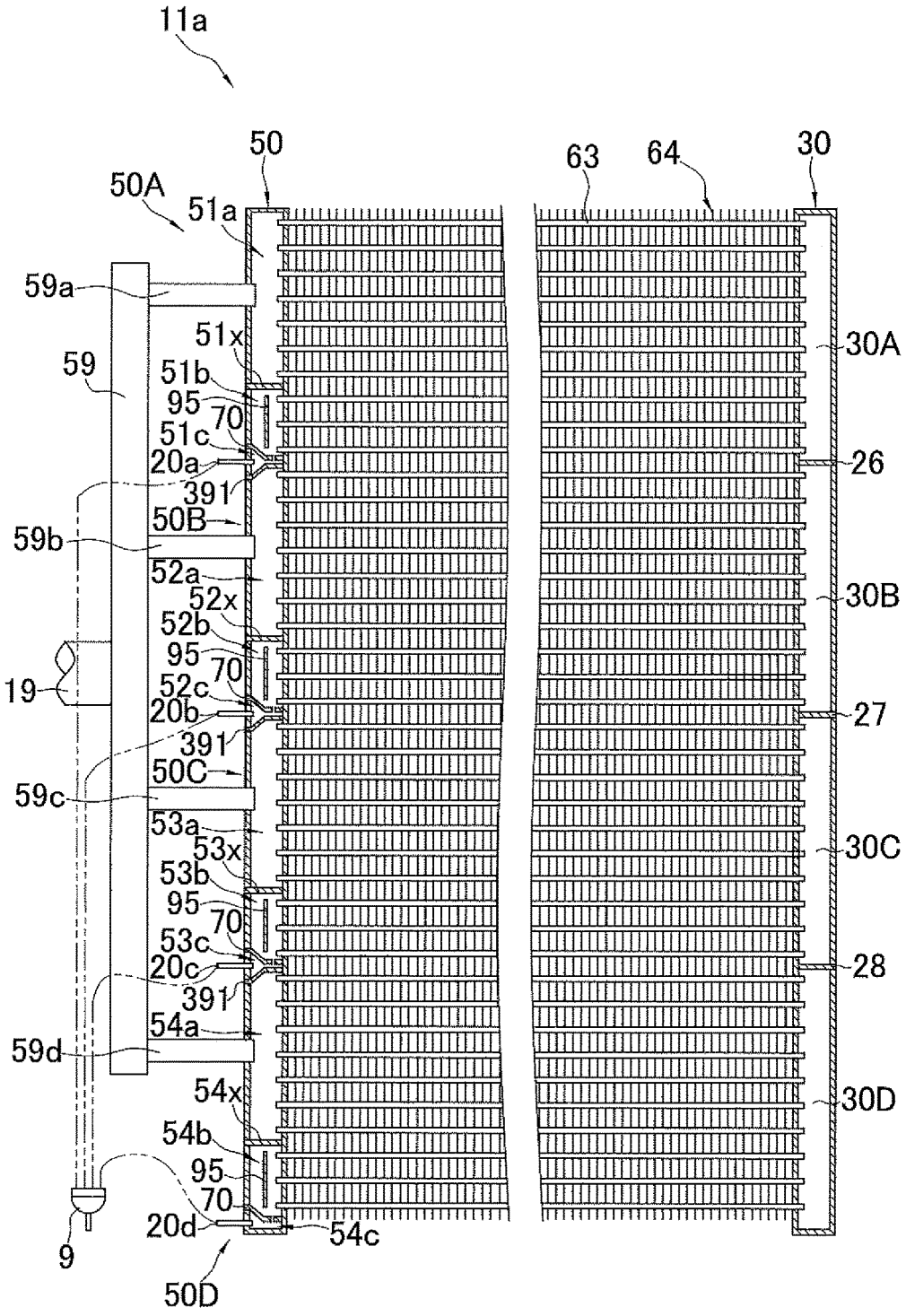
FIG. 17 is a structure diagram explaining refrigerant flow in the outdoor heat exchanger according to Modified Example D.

For example as illustrated in FIGS. 16 and 17, in an outdoor heat exchanger 11*a* in which a header collecting pipe 50 and a turnaround header 30, both being erected, are connected by the plurality of flat multi-hole tubes 63 vertically arranged, the refrigerant after divided by a flow divider 9 may be introduced through individual branch pipes 20*a* to 20*d* into individual introduction spaces 51*c* to 54*c* in the header collecting pipe 50, and in these sites, the refrigerant may be divided into the flat multi-hole tubes 63 at the individual levels of height while being blown up by using the nozzles.

The inside of the header collecting pipe 50 of the outdoor heat exchanger 11*a* is divided for every path of the refrigerant flow, and more specifically into first to fourth divisional flow spaces 50A to 50D, in that order from the top to the bottom. The first to fourth divisional flow spaces 50A to 50D are vertically partitioned by the partially inclined partitioning member 391 having no nozzle formed therein, which is same as that in the aforementioned embodiments. Also the inside of the turnaround header 30 of the outdoor heat exchanger 11*a* is divided for every path of the refrigerant flow, into first to fourth turnaround spaces 30A to 30D, in that order from the top to the bottom, corresponding respectively to the first to fourth divisional flow spaces 50A to 50D of the header collecting pipe 50. The first to fourth turnaround spaces 30A to 30D are vertically partitioned by partition plates 26, 27, 28 having formed therein no opening or the like.

An upper space 51*a*, a circulation space 51*b*, and an introduction space 51*c* are further disposed and arranged in that order from the top to the bottom in the first divisional flow space 50A of the header collecting pipe 50. The upper space 51*a* and the circulation space 51*b* are partitioned by a partition plate 51*x* in the vertical direction. The circulation space 51*b* and the introduction space 51*c* are divided in the vertical direction, by the partially inclined partitioning member with nozzle 70 same as that in the aforementioned embodiments. The inside of the circulation space 51*b* is same as that in the aforementioned embodiments, in that the structure has the circulation diaphragm 95, and can circulate the refrigerant. Features regarding that the lower end of the introduction space 97 is composed of the partially inclined partitioning member 391, and that the upper end of the introduction space 97 is composed of the partially inclined partitioning member with nozzle 70, are same as those in Modified Example C.

The inside of the second divisional flow space 50B of the header collecting pipe 50 is same as that in the first divisional flow space 50A, in which an upper space 52*a*, a circulation space 52*b*, and an introduction space 52*c* are further disposed and arranged in that order from the top to the bottom. The upper space 52*a* and the circulation space 52*b* are partitioned by a partition plate 52*x* in the vertical direction, and the circulation space 52*b* and the introduction space 52*c* are partitioned by the partially inclined partitioning member with nozzle 70 in the vertical direction.

The inside of the third divisional flow space 50C of the header collecting pipe 50 is same as that in the first divisional flow space 50A, in which an upper space 53*a*, a circulation space 53*b*, and an introduction space 53*c* are further disposed and arranged in that order from the top to the bottom. The upper space 53*a* and the circulation space 53*b* are partitioned by a partition plate 51*x* in the vertical direction, and the circulation space 53*b* and the introduction space 53*c* are partitioned by the partially inclined partitioning member with nozzle 70 in the vertical direction.

In the inside of the fourth divisional flow space 50D of the header collecting pipe 50, an upper space 54*a*, a circulation space 54*b*, and an introduction space 54*c* are arranged in that order from the top to the bottom. The upper space 54*a* and the circulation space 54*b* are partitioned by a partition plate 54*x* in the vertical direction, and the circulation space 54*b* and the introduction space 54*c* are partitioned by the partially inclined partitioning member with nozzle 70 in the vertical direction. The lower end of the introduction space 54*c* in the fourth divisional flow space 50D is composed of an end part of the header collecting pipe 50.

In the header collecting pipe 50, protruded are a confluence pipe 59*a* from the upper space 51*a* of the first divisional flow space 50A, a confluence pipe 59*b* from the upper space 52*a* of the second divisional flow space 50B, a confluence pipe 59*c* from the upper space 53*a* of the third divisional flow space 50C, and a confluence pipe 59*d* from the upper space 54*a* of the fourth divisional flow space 50D, all pipes being connected to a confluence part 59 from which the refrigerant pipe 19 extends.

When the outdoor heat exchanger 11*a* is used as an evaporator of refrigerant, the refrigerant divided by the flow divider 9 flows through the individual branch pipes 20*a* to 20*d* into the individual introduction spaces 51*c* to 54*c* in the header collecting pipe 50. The refrigerant is then blown up through the nozzles of the partially inclined partitioning members with nozzles 70 in the individual introduction spaces 51*c* to 54*c* into the circulation spaces 51*b* to 54*b*, and then distributed into the plurality of flat multi-hole tube 63 connected to the individual circulation spaces 51*b* to 54*b*, while ascending and circulating in the circulation spaces 51*b* to 54*b*. The refrigerant having flowed to the other ends of the flat multi-hole tubes 63 to reach the turnaround header 30 then enters the plurality of flat multi-hole tubes 63 that are connected at higher positions, and flows again towards the header collecting pipe 50. The refrigerant that has reached the individual upper spaces 51*a* to 54*a* of the header collecting pipe 50 then flows through the individual confluence pipes 59*a* to 59*d* into the confluence part 59, and then flows towards the refrigerant pipe 19. For the outdoor heat exchanger 11*a* used as a condenser, the aforementioned flow will be inverted overall.

Also the thus structured outdoor heat exchanger 11*a* can demonstrate effects same as those described in the aforementioned embodiments and the individual Modified Examples described above.

(7-5) Modified Example E

The aforementioned embodiments have been explained referring to the case where the flat multi-hole tube 63 is not connected to the introduction space 97.

In contrast, a heat exchanger may have a structure that the flat multi-hole tube 63 is connected to the introduction space 97. Even in this case, since the vertical width of the introduction space 97 is successfully made narrower on the side closer to the nozzles 71*a*, than on the side the first connection pipe 24 is connected, so that the number of flat multi-hole tubes 63 to be connected to the introduction space 97 may be reduced. Hence, it now becomes possible to reduce the number of flat multi-hole tubes 63 where the refrigerant, before passing through the nozzles 71*a* in the introduction space 97, with a relative high pressure, can enter, and thereby the unequal flow of refrigerant among the plurality of flat multi-hole tubes 63 may be minimized.

(7-6) Modified Example F

The aforementioned embodiments and Modified Examples have been explained referring to a heat exchanger in which the longitudinal direction of the header, such as the second header collecting pipe 90, is aligned vertically, and the plurality of flat multi-hole tubes 63 are arranged in line in the vertical direction.

The heat exchanger is, however, not limited thereto, and may typically be a heat exchanger in which the longitudinal direction of the header extends horizontally or in a direction inclined from the horizontal direction, and the plurality of flat multi-hole tubes are arranged in line along such longitudinal direction of the header.

Also in this case, the heat exchanger can be suppressed from being enlarged in the longitudinal direction of the header, can be suppressed from causing performance degradation, and can suppress the unequal flow of refrigerant among the plurality of flat multi-hole tubes.

Having described the embodiments of the present invention, it would be understood that a variety of modifications will be made on the morphology or other details, without departing from the spirit and scope described in claims.

REFERENCE SIGNS LIST

1 Air conditioner
2 Outdoor unit
11, 11*a* Outdoor heat exchanger (heat exchanger)
20*a* to 20*d* Branch pipe (refrigerant pipe)
24 First connection pipe (refrigerant pipe)
25 Second connection pipe (refrigerant pipe)
50 Header collecting pipe (header)
51*a* to 54*a* Upper space
51*b* to 54*b* Circulation space (supply space, upper space, upper space)
51*c* to 54*c* Introduction space
63 Flat multi-hole tube (flat tube)
63*a* Flat face
64 Fin
70 Partially inclined partitioning member with nozzle
71 Nozzle forming part (first partition part)
71*a* Nozzle (nozzle part)
72 Inclined part (first guide part)
90 Second header collecting pipe (header)
90*a* first header structural member (multi-hole tube-side member)
90*b* second header structural member (opposite-multi-hole tube-side member)
91 Partition plate (lower flat plate part)
92 Partition plate (lower flat plate part)
95 Circulation diaphragm (supply space partitioning member)
95*a* Upper communication slot (first communication path)
95*b* Lower communication slot (second communication path)
95*c* Connection slot
95*f* Connection part
97 Introduction space
98 Circulation space (supply space, upper space, upper space)
98*a* Upflow space (first space)
98*b* Downflow space (second space)
272 Guide member
370 Diaphragm with nozzle (upper flat plate part)
391 Partially inclined partitioning member
391*a* Horizontal partition part (flat tube-side wall part)
391*b* Declined part (second guide)

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat exchanger comprising:
a header having an introduction space and a supply space, wherein
the supply space is adjacent to the introduction space in a longitudinal direction of the header;
flat tubes disposed in line along the longitudinal direction and connected to the header;
a refrigerant pipe connected to the introduction space; and
a nozzle disposed in a boundary between the introduction space and the supply space, wherein
the nozzle is disposed closer to the flat tubes than to the refrigerant pipe,
when the heat exchanger operates as an evaporator of a refrigerant, the refrigerant is fed through the nozzle from the introduction space to the supply space,
the introduction space is divided into a first zone and a second zone, wherein
the refrigerant pipe is connected to the second zone but not to the first zone, and
in the longitudinal direction, a width of the first zone is smaller than a width of the second zone.

2. The heat exchanger according to claim 1, wherein the flat tubes are connected only to the supply space in the header.

3. The heat exchanger according to claim 1, wherein
in the longitudinal direction, the width of the first zone is smaller than a width of the refrigerant pipe where the refrigerant pipe is connected to the introduction space.

4. The heat exchanger according to claim 3, wherein the refrigerant pipe is cylindrical.

5. The heat exchanger according to claim 1, further comprising:
a first partition member that partitions an inside of the header into the introduction space and the supply space, wherein
the first partition member comprises:
a partition that comprises the nozzle; and
a first guide that is inclined toward the supply space continuously or displaced toward the supply space in a stepwise manner, wherein
the partition is disposed closer to the flat tubes than is the first guide.

6. The heat exchanger according to claim 5, wherein the partition and the first guide are an integrated piece that partitions the inside of the header into the introduction space and the supply space.

7. The heat exchanger according to claim 1, further comprising:
a second partition member that forms a wall of the introduction space opposite to the supply space, wherein
the second partition member comprises:
a flat wall; and a second guide that is inclined away from the supply space continuously or is displaced away from the supply space in a stepwise manner, wherein the flat wall is disposed closer to the flat tubes than is the second guide.

8. The heat exchanger according to claim 7, wherein the flat wall and the second guide form, as an integrated piece, the wall of the introduction space opposite to the supply space.

9. The heat exchanger according to claim 1, further comprising:

a first partition member that partitions an inside of the header into the introduction space and the supply space; and a second partition member that forms a wall of the introduction space opposite to the supply space, wherein the first partition member comprises:

a partition comprising the nozzle; and a first guide that is inclined toward the supply space continuously or displaced toward the supply space in a stepwise manner, wherein the partition is disposed closer to the flat tubes than is the first guide, the second partition member comprises:

a flat wall; and a second guide that is inclined away from the supply space continuously or is displaced away from the supply space in a stepwise manner, wherein the flat wall is disposed closer to the flat tubes than is the second guide, the refrigerant pipe is connected to a zone between the first guide and the second guide.

10. The heat exchanger according to claim 1, further comprising:

a supply space partition that partitions the supply space into a first space to which the flat tubes are connected and a second space opposite to where the flat tubes are connected, wherein the first space and the second space communicate through a first communication path disposed on the supply space partition at a position away from the introduction space in the longitudinal direction, the first space and the second space communicate through a second communication path disposed on the supply space partition at a position adjacent to the introduction space in the longitudinal direction, and the refrigerant, after passing through the nozzle, circulates through the first space, the first communication path, the second space, and the second communication path.

11. The heat exchanger according to claim 1, wherein the longitudinal direction is a vertical direction.

12. An air conditioner comprising:

a refrigerant circuit that comprises the heat exchanger according to claim 1.

* * * * *